US007835663B2

(12) United States Patent
Tomatsu

(10) Patent No.: US 7,835,663 B2
(45) Date of Patent: Nov. 16, 2010

(54) IMAGE-FORMING DEVICE HAVING SHEET METAL FRAME FIXED OVER RESIN FRAME WITH SCREWS

(75) Inventor: Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 750 days.

(21) Appl. No.: 11/758,129

(22) Filed: Jun. 5, 2007

(65) Prior Publication Data

US 2008/0003015 A1 Jan. 3, 2008

(30) Foreign Application Priority Data

Jun. 30, 2006 (JP) ..... 2006-181441

(51) Int. Cl.
*G03G 15/00* (2006.01)

(52) U.S. Cl. ..... 399/107; 347/152; 347/245; 347/263; 403/408.1

(58) Field of Classification Search ..... 399/107; 347/138, 152, 170, 222, 245, 263; 403/408.1; 312/223.2; 411/512, 427
See application file for complete search history.

(56) References Cited

U.S. PATENT DOCUMENTS 5,625,437 A 4/1997 Furukawa
5,787,324 A 7/1998 Iwasaki
5,887,225 A 3/1999 Bell
6,128,100 A 10/2000 Uemura et al.
6,282,395 B1 8/2001 Nittani et al.
6,285,851 B1 9/2001 Kojima et al.
6,356,730 B1 3/2002 Nonaka (Continued)

FOREIGN PATENT DOCUMENTS

CN 1503067 A 6/2004

(Continued)

OTHER PUBLICATIONS

Initial Office Action for Chinese Application No. 2007-10129026.6 mailed Jun. 5, 2009 and English translation thereof.

(Continued)

*Primary Examiner*—David M Gray
*Assistant Examiner*—Laura K Roth
(74) *Attorney, Agent, or Firm*—Banner & Witcoff, Ltd.

(57) ABSTRACT

An image-forming device includes: a side wall unit including: a resin frame having a first surface and a second surface opposing the first surface; and a sheet metal frame that is mounted over at least a part of the first surface of the resin frame and is fixed to the resin frame by at least one screw. The resin frame has at least one fixing threaded boss on the second surface, each fixing threaded boss being located at a position corresponding to one of the at least one screw and having a threaded hole opened on the first surface to receive the screw. Each fixing threaded boss includes an outer peripheral wall and an inner peripheral wall, both of which extend from the second surface in a direction away from the sheet metal frame, tip ends of the outer peripheral wall and the inner peripheral walls being connected, the inner peripheral wall being located around the threaded hole. A recessed part is formed in each fixing threaded boss in at least a part of a portion defined between the outer peripheral wall and the inner peripheral wall, thereby allowing the outer peripheral wall to become capable of flexing and deforming.

11 Claims, 19 Drawing Sheets

U.S. PATENT DOCUMENTS

| | | | |
|---|---|---|---|
| 6,427,310 | B1 | 8/2002 | Kerr |
| 6,476,843 | B1 | 11/2002 | Kerr |
| 6,928,251 | B2 | 8/2005 | Yoshihara et al. |
| 7,051,941 | B2 | 5/2006 | Yui |
| 7,303,346 | B2 | 12/2007 | Ogi et al. |
| 2005/0180779 | A1 | 8/2005 | Okamoto |
| 2006/0193656 | A1 | 5/2006 | Kumazawa |
| 2006/0182462 | A1 | 8/2006 | Imada et al. |
| 2007/0160382 | A1 | 7/2007 | Tomatsu |
| 2008/0002341 | A1 | 1/2008 | Tomatsu |

FOREIGN PATENT DOCUMENTS

| | | | |
|---|---|---|---|
| CN | 1527070 | A | 9/2004 |
| JP | 57-005508 | | 6/1980 |
| JP | 62-92309 | | 6/1987 |
| JP | 62-025404 | | 7/1987 |
| JP | 04-012207 | | 5/1990 |
| JP | 5-165264 | A | 4/1993 |
| JP | 5-188666 | A | 4/1993 |
| JP | 5-181326 | A | 7/1993 |
| JP | 05-216347 | | 8/1993 |
| JP | 5-307280 | A | 11/1993 |
| JP | 06-067503 | | 3/1994 |
| JP | 06-051512 | | 7/1994 |
| JP | 7-281580 | A | 10/1995 |
| JP | 08-006385 | | 1/1996 |
| JP | 08-062920 | | 3/1996 |
| JP | 8-087149 | A | 4/1996 |
| JP | 8-101546 | A | 4/1996 |
| JP | 8-262827 | A | 10/1996 |
| JP | 9-050157 | A | 2/1997 |
| JP | 09-141972 | | 6/1997 |
| JP | 10-039577 | | 2/1998 |
| JP | 10-123786 | | 5/1998 |
| JP | 10-142875 | A | 5/1998 |
| JP | 10-161507 | A | 6/1998 |
| JP | 10-301421 | | 11/1998 |
| JP | 11-119545 | | 4/1999 |
| JP | 11-177254 | A | 7/1999 |
| JP | 11-258885 | A | 9/1999 |
| JP | 11-282251 | | 10/1999 |
| JP | 2000-019930 | | 1/2000 |
| JP | 2000-075772 | | 3/2000 |
| JP | 2000-258715 | | 9/2000 |
| JP | 2001-005285 | | 1/2001 |
| JP | 2001-071584 | A | 3/2001 |
| JP | 2001-077548 | | 3/2001 |
| JP | 2001-108072 | A | 4/2001 |
| JP | 2001-117305 | A | 4/2001 |
| JP | 2001-166550 | A | 6/2001 |
| JP | 2001-246807 | | 9/2001 |
| JP | 2001-296494 | | 10/2001 |
| JP | 2002-009457 | A | 1/2002 |
| JP | 2002-021942 | | 1/2002 |
| JP | 2002-040738 | A | 2/2002 |
| JP | 2002-149027 | | 5/2002 |
| JP | 2002-149028 | | 5/2002 |
| JP | 2002-244396 | | 8/2002 |
| JP | 2002-311365 | | 10/2002 |
| JP | 2002-341467 | A | 11/2002 |
| JP | 2003-307894 | A | 10/2003 |
| JP | 2004-077788 | | 3/2004 |
| JP | 2005-077637 | | 3/2005 |
| JP | 2005-195946 | A | 7/2005 |
| JP | 2005-227603 | | 8/2005 |

OTHER PUBLICATIONS

Non-Final Office Action in U.S. Appl. No. 11/564,592 dated Nov. 17, 2009.

Co-pending U.S. Appl. No. 11/758,110, "Image-Forming Device Having Side Walls", filed Jun. 5, 2007.

US Office Action dtd Apr. 26, 2010, U.S. Appl. No. 11/758,110.

IMAGE-FORMING DEVICE HAVING SHEET METAL FRAME FIXED OVER RESIN FRAME WITH SCREWS

CROSS REFERENCE TO RELATED APPLICATION

This application claims priority from Japanese Patent Application No. 2006-181441 filed Jun. 30, 2006. The entire content of this priority application is incorporated herein by reference.

TECHNICAL FIELD

The present invention relates to an image-forming device.

BACKGROUND

Image-forming devices well known in the art have been constructed of a sheet metal frame and a resin frame for supporting and positioning various components, including a paper cassette, a belt for conveying paper, a process unit including a photosensitive drum and a developing device, a scanning unit for exposing the photosensitive drum, a transferring unit, a fixing unit, and a discharge device for discharging paper. An example of such an image-forming device is disclosed in Japanese unexamined patent application publication No. 2001-77548.

Use of the resin frame described above increases the level of freedom in designing the image-forming device since the resin can easily be molded into complex shapes. Consequently, a more compact image-forming device can be produced by arranging the components efficiently. However, since resin frames have low stiffness, mounting a sheet metal frame having high stiffness on the resin frame can reinforce the resin frame and improve the positioning precision of the components. In this way, it is possible both to reduce the size of the image-forming device and to improve positioning precision of the components therein.

SUMMARY

It is an object of the present invention to provide an image-forming device capable of further enhancing the positioning precision of the components therein.

In order to attain the above and other objects, the invention provides an image-forming device, including: a side wall unit including: a resin frame having a first surface and a second surface opposing the first surface; and a sheet metal frame that is mounted over at least a part of the first surface of the resin frame and is fixed to the resin frame by at least one screw. The resin frame has at least one fixing threaded boss on the second surface, each fixing threaded boss being located at a position corresponding to one of the at least one screw and having a threaded hole opened on the first surface to receive the screw. Each fixing threaded boss includes an outer peripheral wall and an inner peripheral wall, both of which extend from the second surface in a direction away from the sheet metal frame, tip ends of the outer peripheral wall and the inner peripheral walls being connected, the inner peripheral wall being located around the threaded hole. A recessed part is formed in each fixing threaded boss in at least a part of a portion defined between the outer peripheral wall and the inner peripheral wall, thereby allowing the outer peripheral wall to become capable of flexing and deforming.

BRIEF DESCRIPTION OF THE DRAWINGS

The particular features and advantages of the invention as well as other objects will become apparent from the following description taken in connection with the accompanying drawings, in which.

DETAILED DESCRIPTION

A laser printer 1 according to an embodiment of the present invention will be described while referring to FIGS. 1 through 18.

Figure 1:
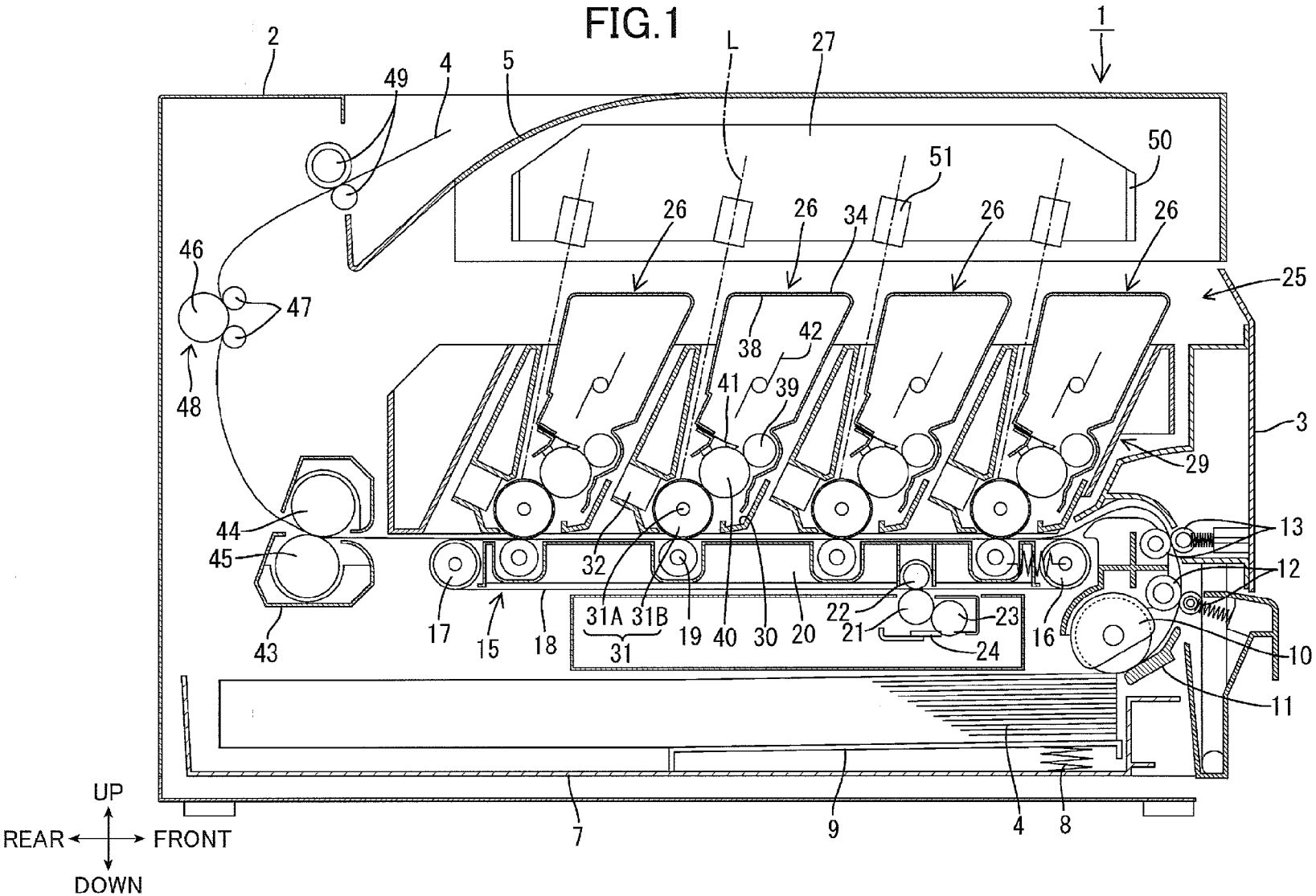
FIG. 1 is a side cross-sectional view showing the general structure of a laser printer according to an embodiment.

The terms "upward," "downward," "upper," "lower," "above," "below", "beneath," "right," "left, " "front," "rear," and the like will be used throughout the description under the assumption that the laser printer 1 is disposed in an orientation of intended use. In use, the laser printer 1 is disposed as shown in FIG. 1.

The laser printer 1 is a color laser printer employing a direct transfer tandem system and includes a substantially box-shaped main casing 2. The main casing 2 accommodates a plurality of modules, including a process unit 25, a scanning unit 27, a paper cassette 7, a belt unit 15, a discharge device 48, and a fixing unit 43.

Overall, the main casing 2 has a rectangular parallelepiped shape open through the front-to-rear direction. The main casing 2 is configured of a main frame body 55 (see FIGS. 2 and 3), and an outer cover (not shown) formed of a synthetic resin for covering the outer surface of the main frame body 55. As shown in FIG. 1, a front cover 3 is provided on the front surface of the main casing 2 and is capable of opening and closing thereon. A discharge tray 5 is formed on the top surface of the main casing 2 for holding sheets of a paper 4 in a stacked state after images have been formed thereon.

Figure 2:
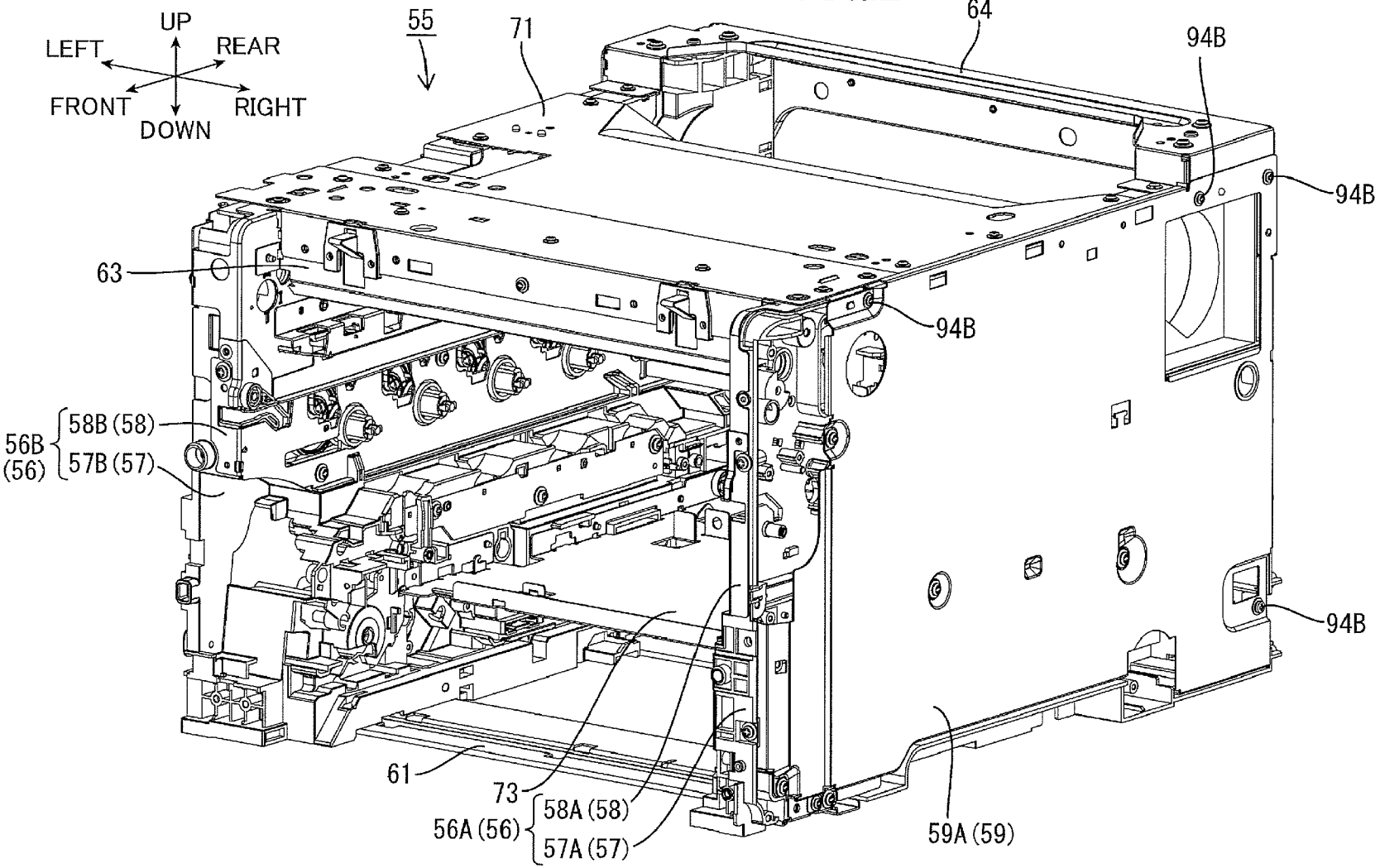
FIG. 2 is a perspective view of a main frame body seen from the front upper right of the laser printer.
Figure 3:
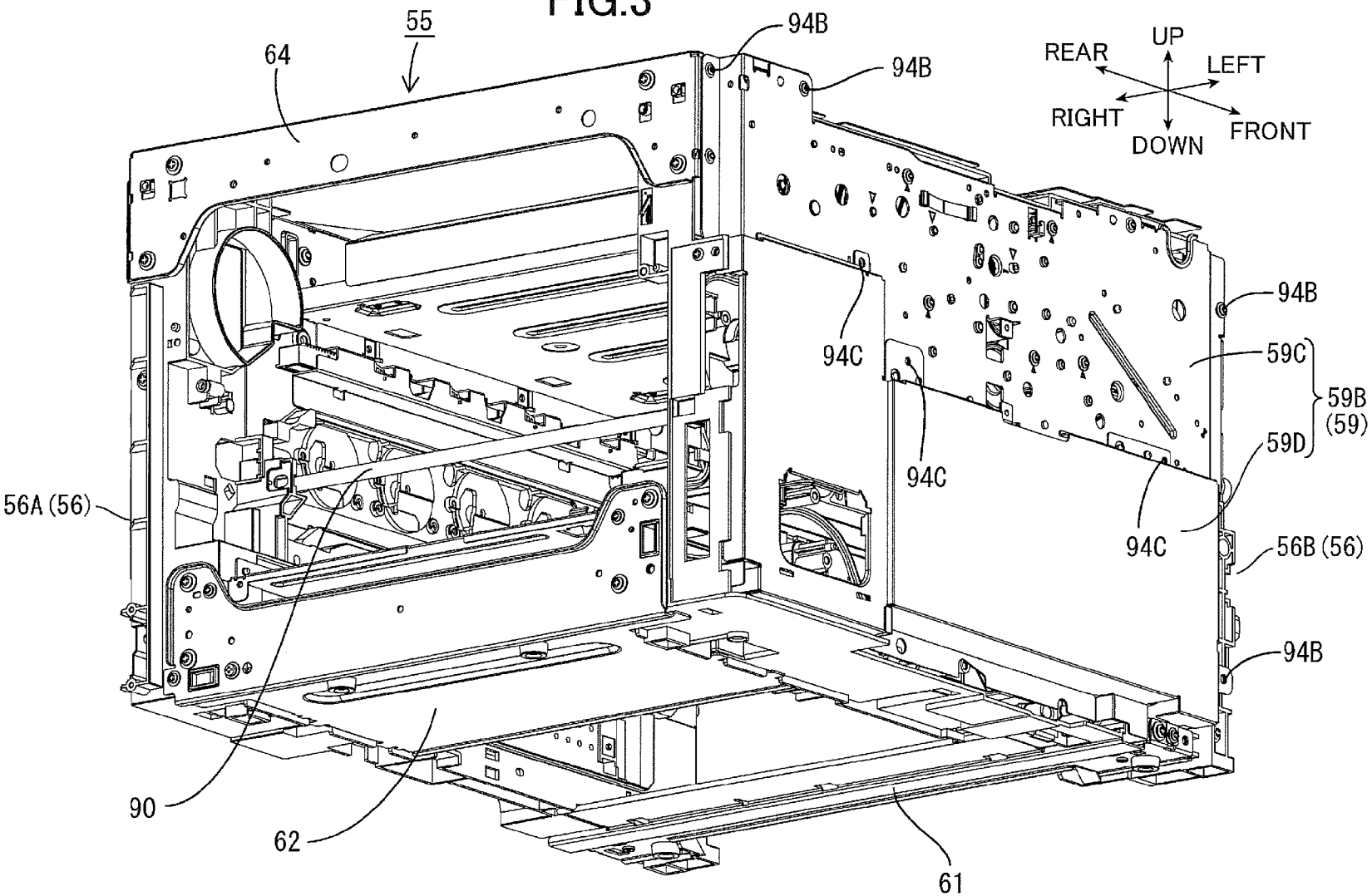
FIG. 3 is a perspective view of the main frame body seen from the rear lower left of the laser printer.

As shown in FIGS. 2 and 3, the main frame body 55 includes a pair of side walls 56 (right side wall 56A and left side wall 56B) opposing each other; a metal bottom beam 61 and a metal bottom plate 62 fixed by screws to the bottom edges of the side walls 56 for linking these edges; and a metal front beam 63 and a metal rear beam 64 fixed by screws to the top edges of the side walls 56 for linking these edges.

As shown in FIG. 3, the bottom beam 61 is attached to the bottom edges of both side walls 56 at a position near the front end thereof. Further, the bottom plate 62 is attached to the bottom edges of both side walls 56 on the rear side of the bottom beam 61. The bottom plate 62 is a metal plate bent substantially into an L-shape. The bottom beam 61 and bottom plate 62 improve the strength of the main casing 2.

As shown in FIG. 2, the front beam 63 is attached to the top edges of the side walls 56 at a position near the front end thereof. Further, the rear beam 64 is attached to the top edges of both side walls 56 at a position near the rear ends thereof and is formed with a substantially L-shape cross section. The front beam 63 and rear beam 64 also improve the strength of the main casing 2.

As shown in FIG. 1, the paper cassette 7 is provided in a lower section of the main casing 2 and can be pulled out of the main casing 2 in the forward direction. The paper cassette 7 accommodates stacked sheets of the paper 4 used for image formation. A paper-pressing plate 9 is provided in the paper cassette 7 and pivots by an urging force of a spring 8 to raise the front edge side of the paper 4. Disposed in the main casing 2 at positions above the front edge of the paper cassette 7 are a pickup roller 10, a separating pad 11, a pair of feeding rollers 12, and a pair of registration rollers 13.

The paper-pressing plate 9 pushes up the paper 4 accommodated in the paper cassette 7 so that the topmost sheet of paper 4 is pressed against the pickup roller 10. As the pickup roller 10 rotates, the paper 4 becomes interposed between the pickup roller 10 and separating pad 11 and the topmost sheet is separated from the paper 4 accommodated in the paper cassette 7 one sheet at a time. The sheet separated and conveyed by the pickup roller 10 and separating pad 11 arrives at the feeding rollers 12, and the feeding rollers 12 convey the sheet to the registration rollers 13. At a prescribed timing, the registration rollers 13 convey the sheet of paper 4 rearward onto the belt unit 15.

The belt unit 15 is detachably mounted in the main casing 2 and is provided with a belt frame 20 formed of a synthetic resin in the shape of a rectangular plate. The belt frame 20 is disposed in a level orientation in the main casing 2 and rotatably supports thereon belt support rollers 16 and 17 at front and rear ends thereof. An endless conveying belt 18 is stretched around the belt support rollers 16 and 17. The conveying belt 18 is formed of a synthetic resin, such as polycarbonate. When the belt support roller 17 disposed on the rear side of the belt frame 20 is driven to rotate, the conveying belt 18 moves circularly in a counterclockwise direction in FIG. 1 so that the paper 4 resting on the top surface of the conveying belt 18 is conveyed rearward. The belt support roller 16 positioned on the front side of the belt frame 20 is a tension roller that can be adjusted in position with respect to the front-to-rear direction. Tension is applied to the conveying belt 18 by urging the belt support roller 16 in the forward direction. Four transfer rollers 19 are rotatably supported in the belt frame 20 between the belt support rollers 16 and 17 at regular intervals in the front-to-rear direction. The transfer rollers 19 are positioned opposite photosensitive drums 31 of respective image-forming units 26 described later so that the conveying belt 18 is pinched between the transfer rollers 19 and the corresponding photosensitive drums 31. During a transfer operation, a transfer bias is generated between the transfer rollers 19 and photosensitive drums 31.

Beneath the belt unit 15 are provided a cleaning roller 21, a backup roller 22, a recovery roller 23, and a blade 24 that function to remove toner, paper dust, and the like deposited on the conveying belt 18.

The process unit 25 is disposed in the main casing 2 above the belt unit 15. The scanning unit 27 is disposed in an upper section of the main casing 2 above the process unit 25.

While not shown in detail in the drawings, the scanning unit 27 includes a casing 50. Within the casing 50 are provided four laser light-emitting elements, one polygon mirror, a scanner motor, and a plurality of lenses and reflecting mirrors. Four irradiating lenses 51 are also disposed on the bottom surface of the casing 50. The scanning unit 27 irradiates laser beams L for each color used in the laser printer 1 onto the surfaces of the photosensitive drums 31 in a high-speed scan.

By opening the front cover 3 described above, the process unit 25 can be pulled out of the main casing 2 in the forward direction. Four of the image-forming units 26 corresponding to the colors magenta, yellow, cyan, and black are provided in the process unit 25, juxtaposed in the front-to-rear direction. Each image-forming unit 26 includes the photosensitive drum 31 mentioned above, a Scorotron charger 32, and a developer cartridge 34. The process unit 25 is also provided with a frame 29 having four cartridge mounting sections 30 arranged in the front-to-rear direction. Each cartridge mounting section 30 is open on the top and bottom. The developer cartridges 34 are detachably mounted in the cartridge mounting sections 30.

Figure 8:
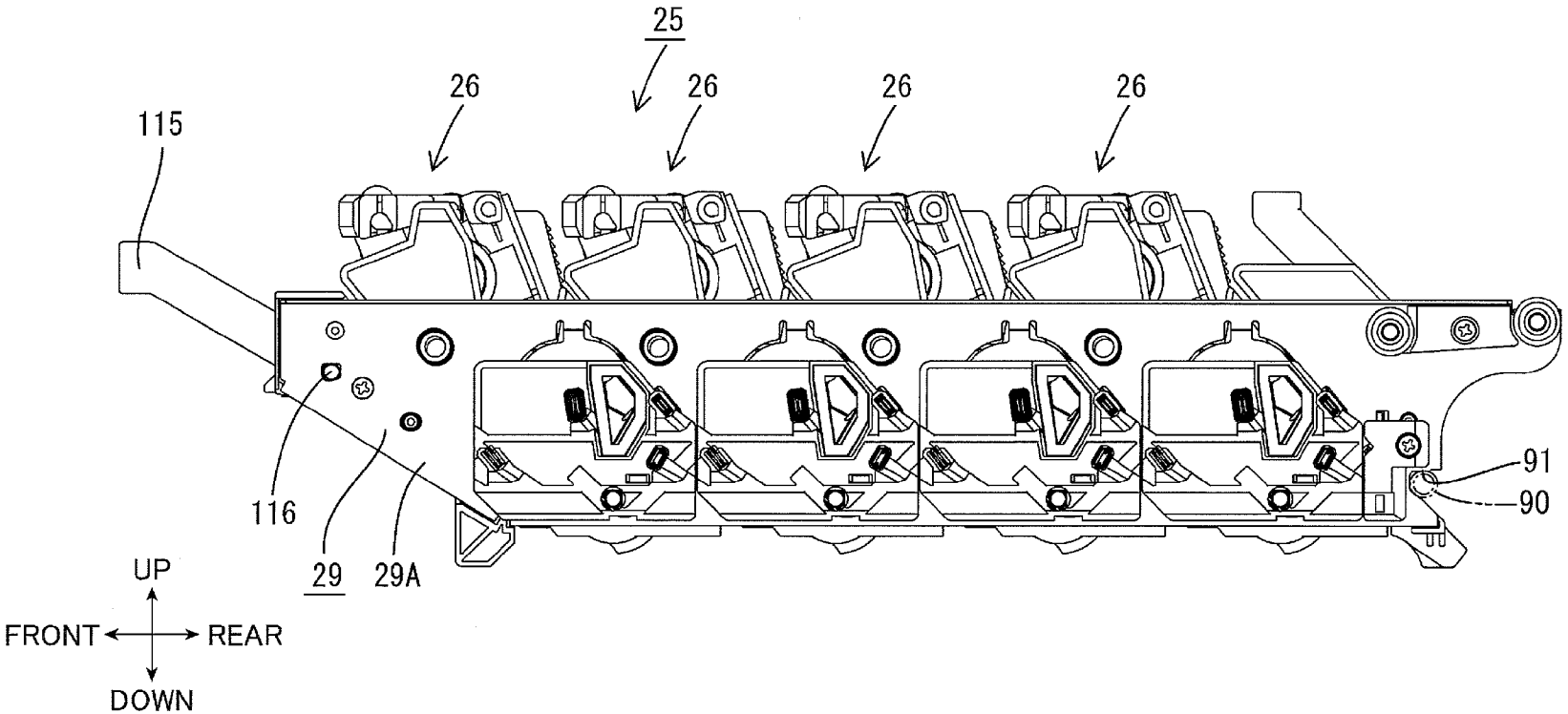
FIG. 8 is a right side view of a process unit.

As shown in FIG. 8, a grip part 115 is disposed on the front end of the frame 29 constituting the process unit 25. The grip part 115 is disposed substantially near the widthwise center of the process unit 25 and protrudes forward. The grip part 115 is rotatably attached to side plates 29A of the frame 29 by a support shaft 116 extending in the width direction of the process unit 25.

Figure 9:
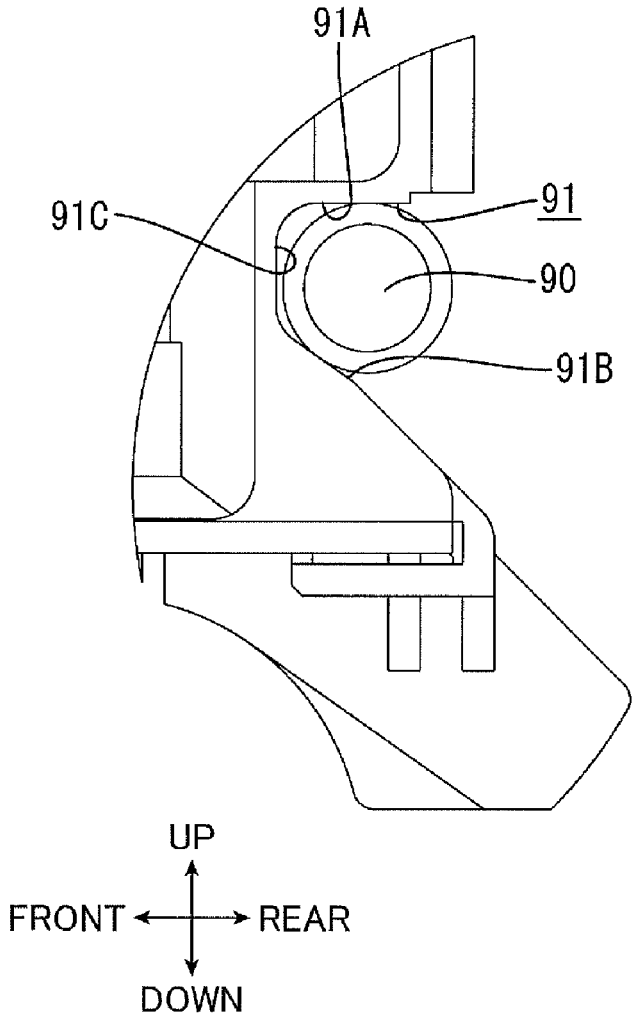
FIG. 9 is an enlarged side view of an essential part in FIG. 8, showing a structure for positioning the process unit and reference shaft.

Cutout parts 91 are formed in the rear ends of the side plates 29A of the frame 29 near the bottom edges thereof, cutting into the side plates 29A in the forward direction. The cutout parts 91 grip a reference shaft 90 described later from above and below. As shown in FIG. 9, the cutout part 91 has an upper edge 91A and a lower edge 91B for pinching the reference shaft 90. With this construction, the process unit 25 can be positioned both vertically and in the front-to-rear direction based on the reference shaft 90. The upper edge 91A of the cutout part 91 is a flat surface extending in the front-to-rear direction from the rear edges of the side plates 29A of the frame 29 to the deepest part (front side) of the cutout parts 91. The lower edges 91B of the cutout parts 91 are flat surfaces sloping upward and forward from the rear edges of the side plates 29A to the deepest parts of the cutout parts 91. The cutout part 91 also has a deepest edge 91C formed as a flat vertical surface that links the front end of the upper edge 91A to the front end of the lower edge 91B. Connecting parts between the front end of the upper edge 91A and the top end of the deepest edge 91C and between the front end of the lower edge 91B and the bottom end of the deepest edge 91C are curved.

As shown in FIG. 1, the photosensitive drum 31 of each image-forming unit 26 is held in the frame 29 at the bottom end position of the respective cartridge mounting section 30. The respective charger 32 is also held in the frame 29 adjacent to the photosensitive drum 31.

The photosensitive drum 31 includes a drum shaft 31A and a main drum body 31B.

The Scorotron charger 32 includes a charging wire and a grid (not shown) for generating a corona discharge to uniformly charge the surface of the photosensitive drum 30 positively.

Each developer cartridge 34 has a substantially box shape. A toner-accommodating chamber 38 is provided in a top section inside the developer cartridge 34. The developer cartridge 34 also accommodates a supply roller 39, a developing roller 40, and a thickness-regulating blade 41 which are disposed below the toner-accommodating chamber 38. The toner-accommodating chamber 38 in each of the developer cartridges 34 accommodates toner with a positive charging nature in one of the colors yellow, magenta, cyan, and black. An agitator 42 is also disposed in the toner-accommodating chamber 38 in each of the developer cartridges 34.

As the photosensitive drum 31 rotates, the corresponding charger 32 charges the surface of the photosensitive drum 31 with a uniform positive polarity. Subsequently, the scanning unit 27 irradiates a laser beam L in a high-speed scan to expose the surface of the photosensitive drum 31, forming an electrostatic latent image on the photosensitive drum 31 corresponding to an image to be formed on the paper 4.

As the developing roller 40 rotates, positively charged toner carried on the surface of the developing roller 40 is brought into contact with the photosensitive drum 31, at which time toner is supplied to the electrostatic latent image formed on the surface of the photosensitive drum 31, thereby developing the electrostatic latent image into a visible image. In other words, toner is deposited only in regions of the surface of the photosensitive drum 31 that have been exposed to the laser beam so that a toner image is carried on the surface of the photosensitive drum 31.

When a sheet of the paper 4 conveyed on the conveying belt 18 passes through each transfer position between the photosensitive drums 31 and corresponding transfer rollers 19, the toner images carried on the surfaces of the photosensitive drums 31 are sequentially transferred onto the paper 4 by a negative transfer bias applied to the transfer rollers 19. After the toner images are transferred in this way, the paper 4 is conveyed to the fixing unit 43.

The fixing unit 43 is disposed in the main casing 2 rearward of the conveying belt 18. The fixing unit 43 includes a heating roller 44, and a pressure roller 45. When the paper 4 carrying toner images in four colors is conveyed to the fixing unit 43, the heating roller 44 and pressure roller 45 pinch and convey the paper 4, while the heating roller 44 applies heat to the paper 4 for fixing the toner images.

The discharge device 48 is disposed diagonally above and rearward of the fixing unit 43. The discharge device 48 includes a conveying roller 46, a pair of follow rollers 47, and a guide (not shown) for guiding the paper 4. Discharge rollers 49 are disposed in the top section of the main casing 2 above the discharge device 48. After the toner images are fixed on the paper 4 in the fixing unit 43, the discharge device 48 conveys the paper 4 to the discharge rollers 49, and the discharge rollers 49 discharge the paper 4 onto the discharge tray 5 described above.

Next, the structure of the side walls 56 will be described.

Figure 4:
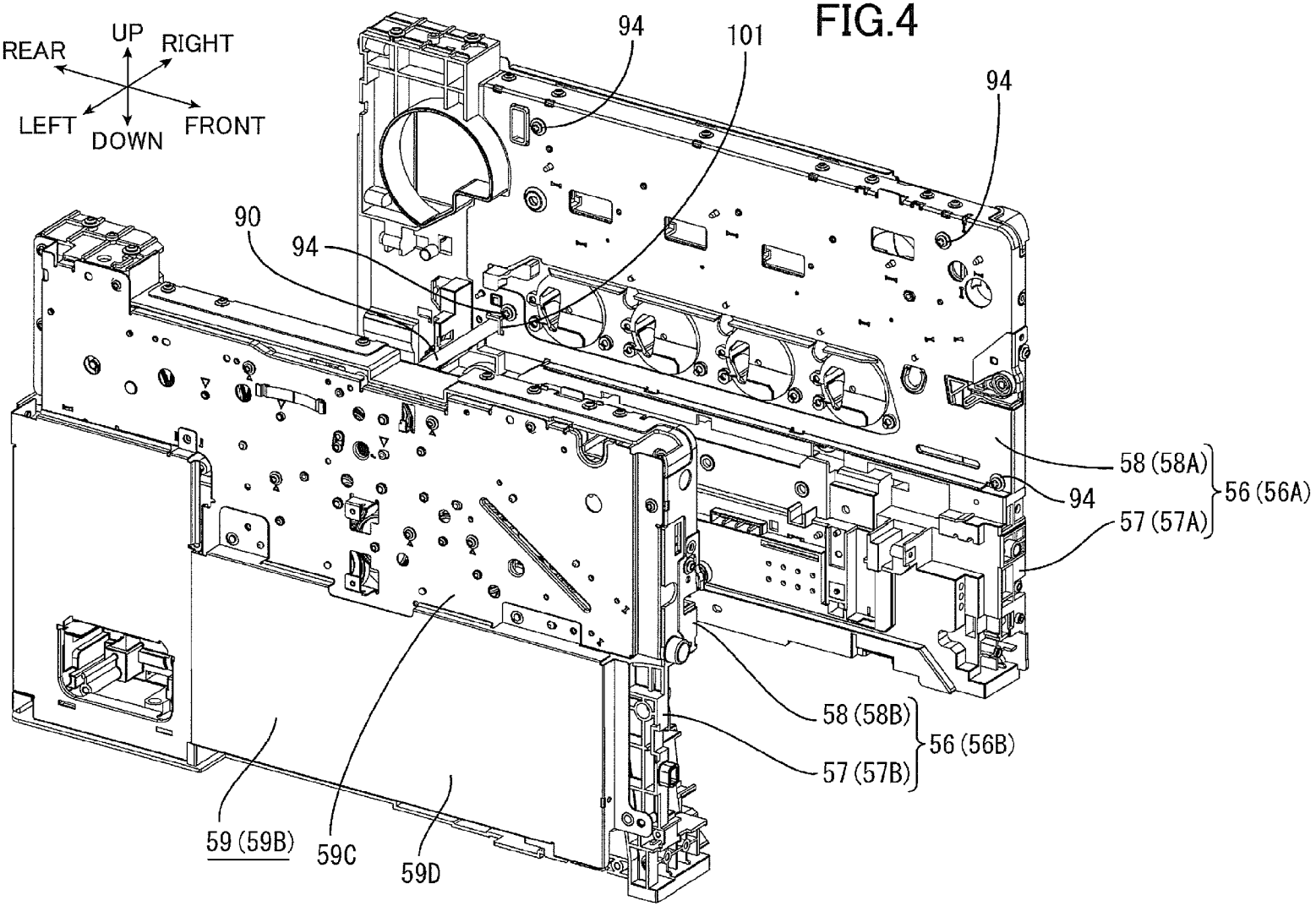
FIG. 4 is a perspective view seen from the front left of the laser printer showing side walls mounted on a reference shaft.
Figure 5:
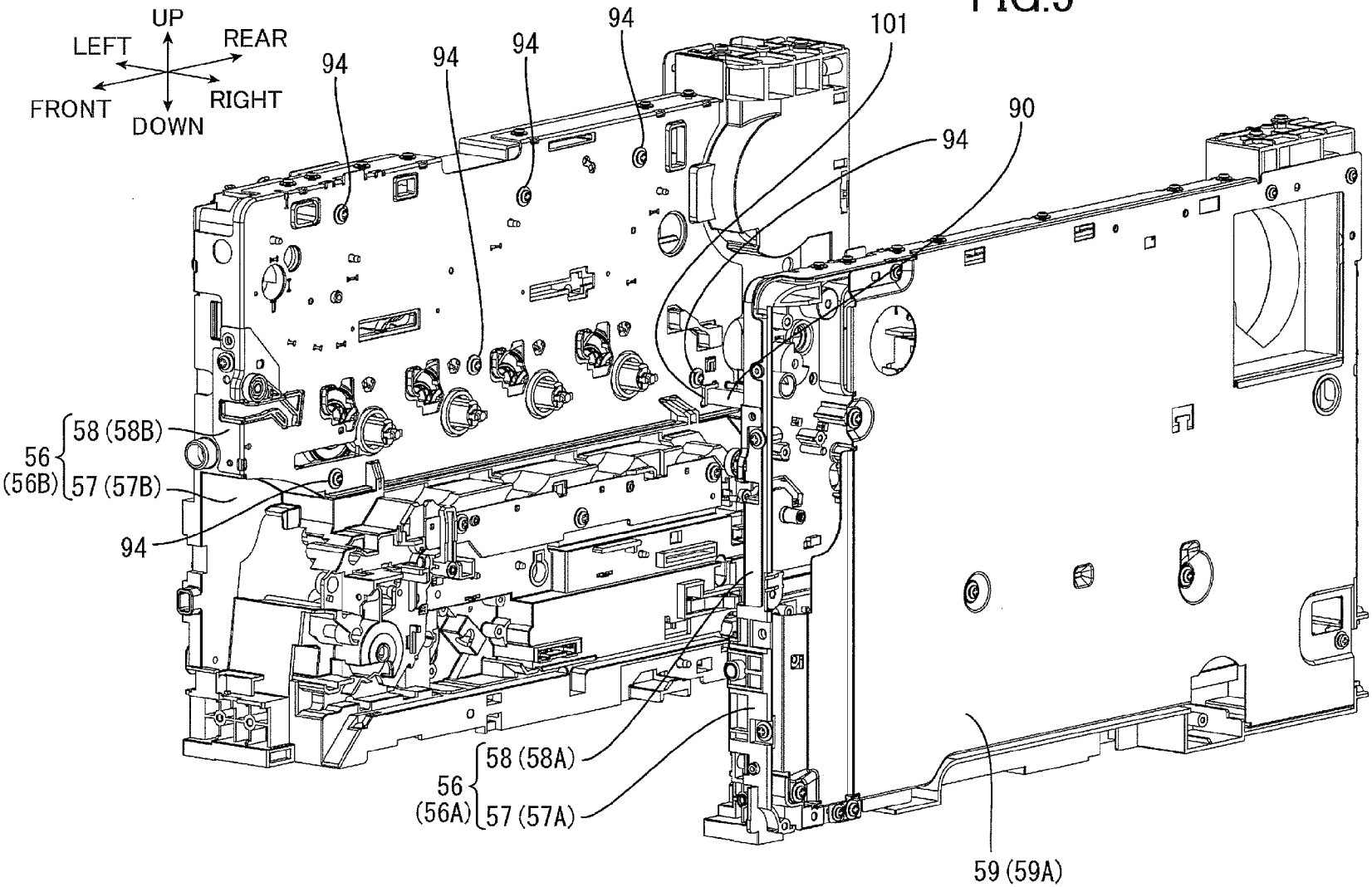
FIG. 5 is a perspective view seen from the front right of the laser printer showing side walls mounted on a reference shaft.

As shown in FIGS. 4 and 5, the right side wall 56A includes: a right resin frame 57A, a right inner-side sheet metal frame 58A, and a right outer-side sheet metal frame 59A. The left side wall 56B includes: a left resin frame 57B, a left inner-side sheet metal frame 58B, and a left outer-side sheet metal frame 59B. The left outer-side sheet metal frame 59B includes a left upper-side outer-side sheet metal frame 59C and a left lower-side outer-side sheet metal frame 59D.

The right side wall 56A and left side wall 56B are collectively referred to as the side walls 56. The right resin frame 57A and the left resin frame 57B are collectively referred to as resin frames 57. The right inner-side sheet metal frame 58A and left inner-side sheet metal frame 58B are collectively referred to as inner-side sheet metal frames 58. The right outer-side sheet metal frame 59A and left outer-side sheet metal frame 59B are collectively referred to as outer-side sheet metal frames 59. Accordingly, it can be said that each side wall 56 includes: a resin frame 57, an inner-side sheet metal frame 58, and an outer-side sheet metal frame 59.

Each resin frame 57 (57A, 57B) is formed of a synthetic resin material in substantially a rectangular shape. The resin frame 57 has an accommodating recessed part 60 (see FIGS. 11 and 13) on its outer side in the thickness direction. The accommodating recessed part 60 is formed by extending the peripheral edge of the resin frame 57 outward in the thickness direction.

The inner-side sheet metal frame 58 is superimposed over and mounted on a wall surface of the resin frame 57 on the inside with respect to the thickness direction. In other words, the inner-side sheet metal frame 58 is laminated over the wall surface of the resin frame 57 on the inside with respect to the thickness direction. The outer-side sheet metal frame 59 is mounted on the outside of the resin frame 57 in the thickness direction, and is attached to the resin frame 57 for covering an open surface of the accommodating recessed part 60. Thus, the outer-side sheet metal frame 59 serves as a lid for covering the open surface of the accommodating recessed part 60.

Figure 10:
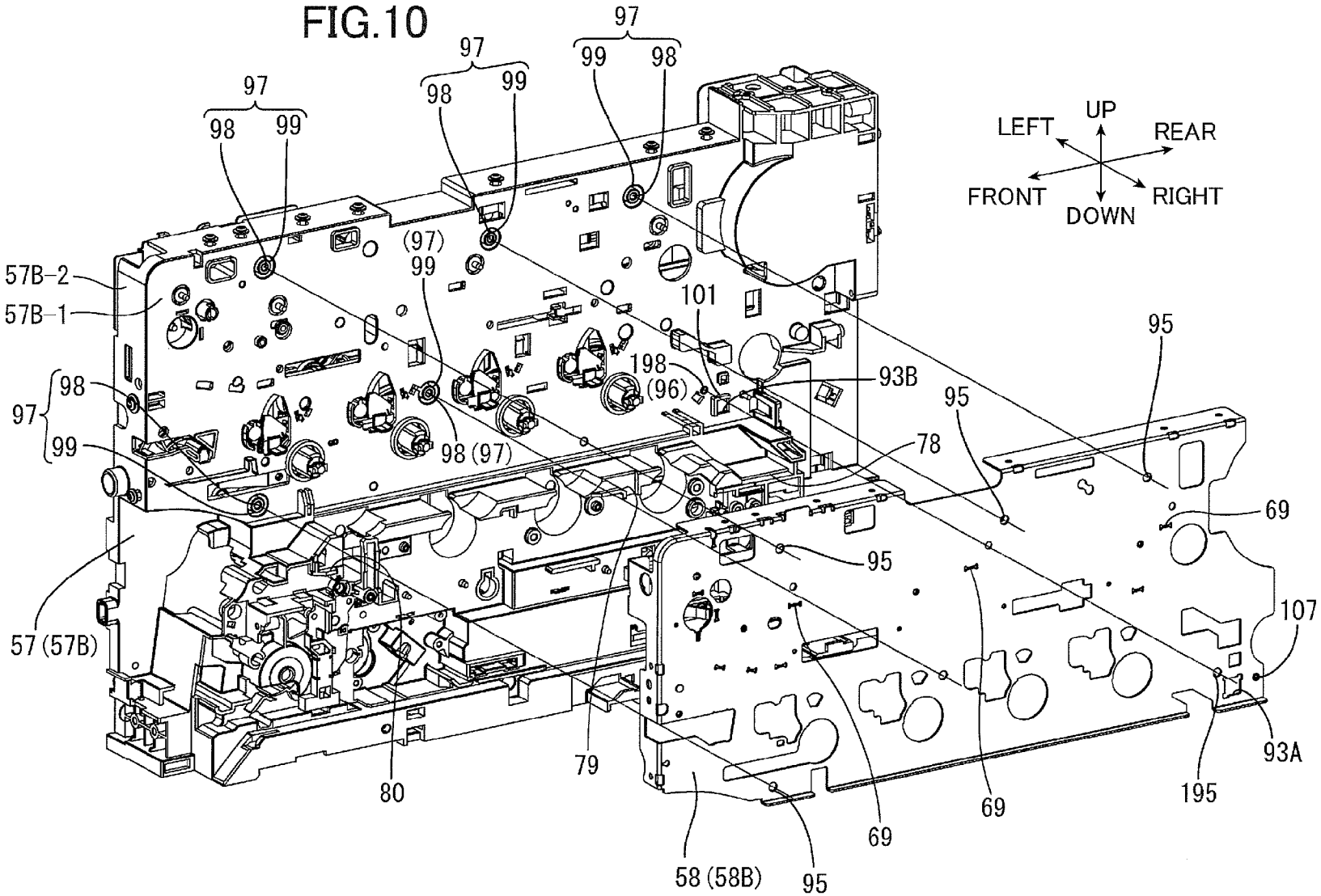
FIG. 10 is a perspective view showing the mounted structure of a resin frame and an inner-side sheet metal frame for the left side wall.
Figure 11:
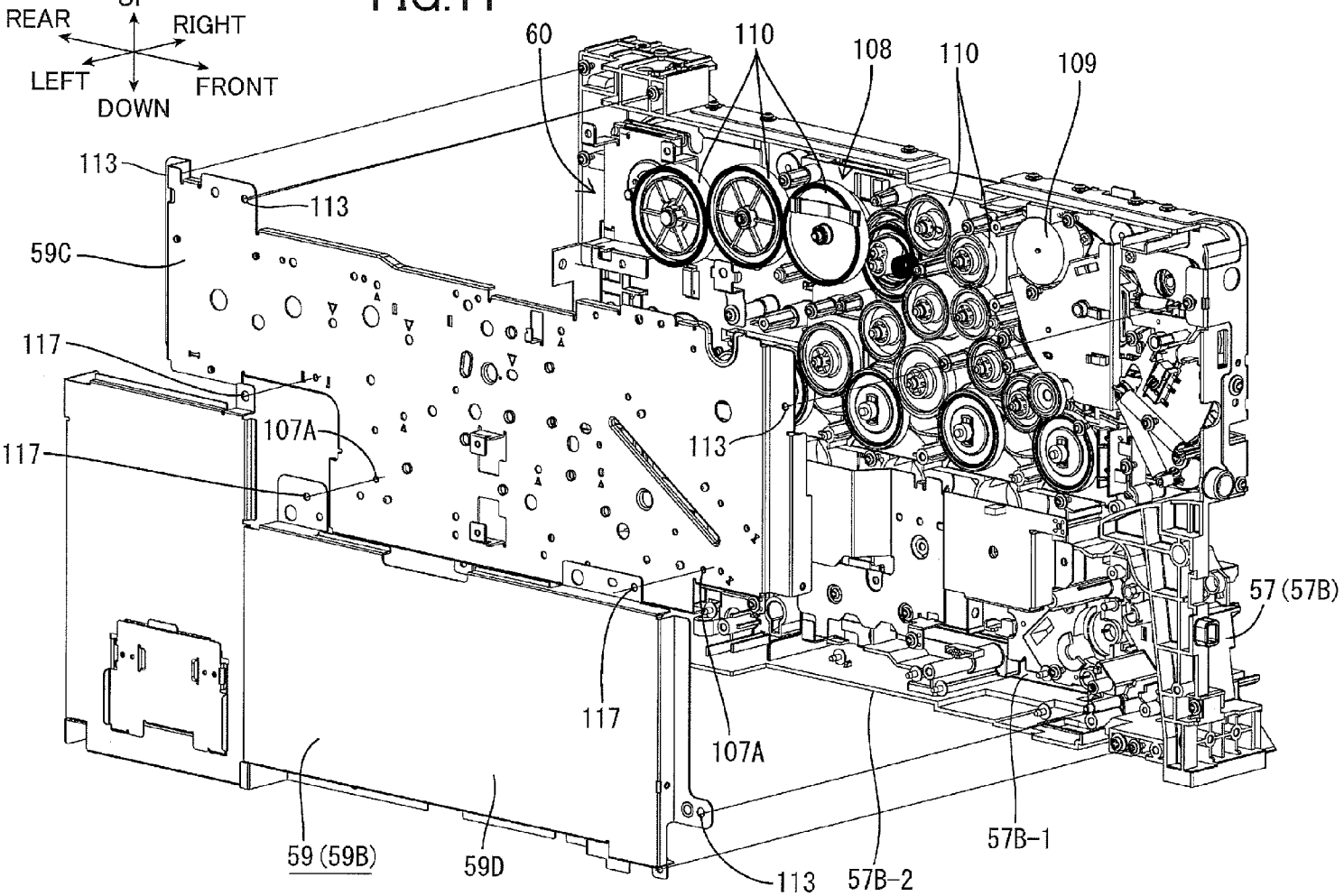
FIG. 11 is a perspective view showing the mounted structure of the resin frame and an outer-side sheet metal frame for the left side wall.

More specifically, as shown in FIGS. 10 and 11, the left resin frame 57B has: a main wall 57B-1 that extends vertically and horizontally; and a peripheral wall 57B-2 that extends from the peripheral edge of the main wall 57B-1 outward in the thickness direction (leftward). The main wall 57B-1 has a pair of opposite surfaces: an outward-facing surface facing outwardly in the thickness direction (leftward); and an inward-facing surface facing inwardly in the thickness direction (rightward). As shown in FIG. 10, the left inner-side sheet metal frame 58B is superimposed over and mounted on the inward-facing surface of the main wall 57B-1. As shown in FIG. 11, the left outer-side sheet metal frame 59B is provided confronting the outward-facing surface of the main wall 57B-1 and is attached to the left resin frame 57B covering the open surface of the accommodating recessed part 60. Thus, the accommodating recessed part 60 is surrounded and enclosed by the main wall 57B-1, the peripheral wall 57B-2, and the left outer-side sheet metal frame 59B.

Figure 12:
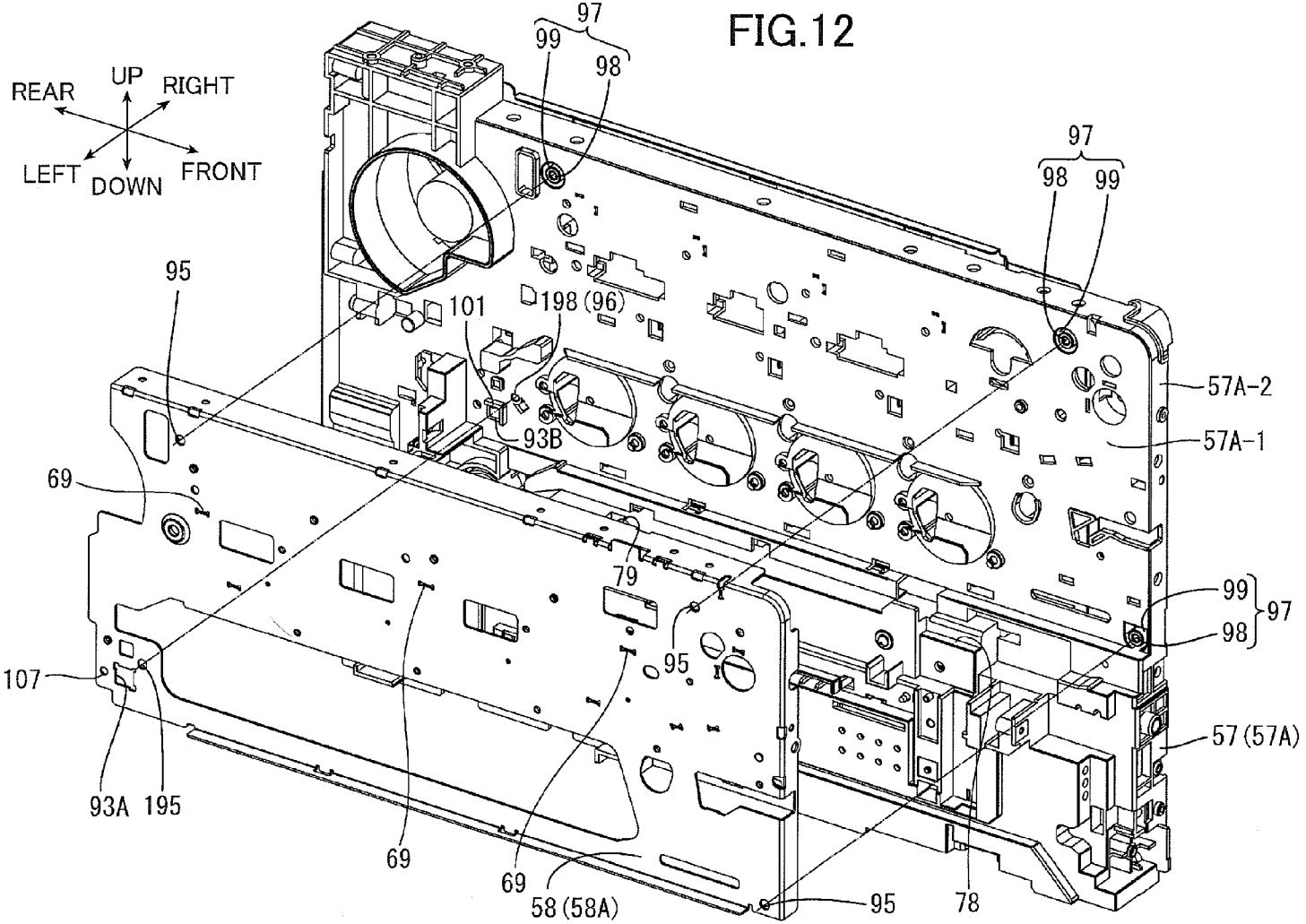
FIG. 12 is a perspective view showing the mounted structure of a resin frame and an inner-side sheet metal frame for the right side wall.
Figure 13:
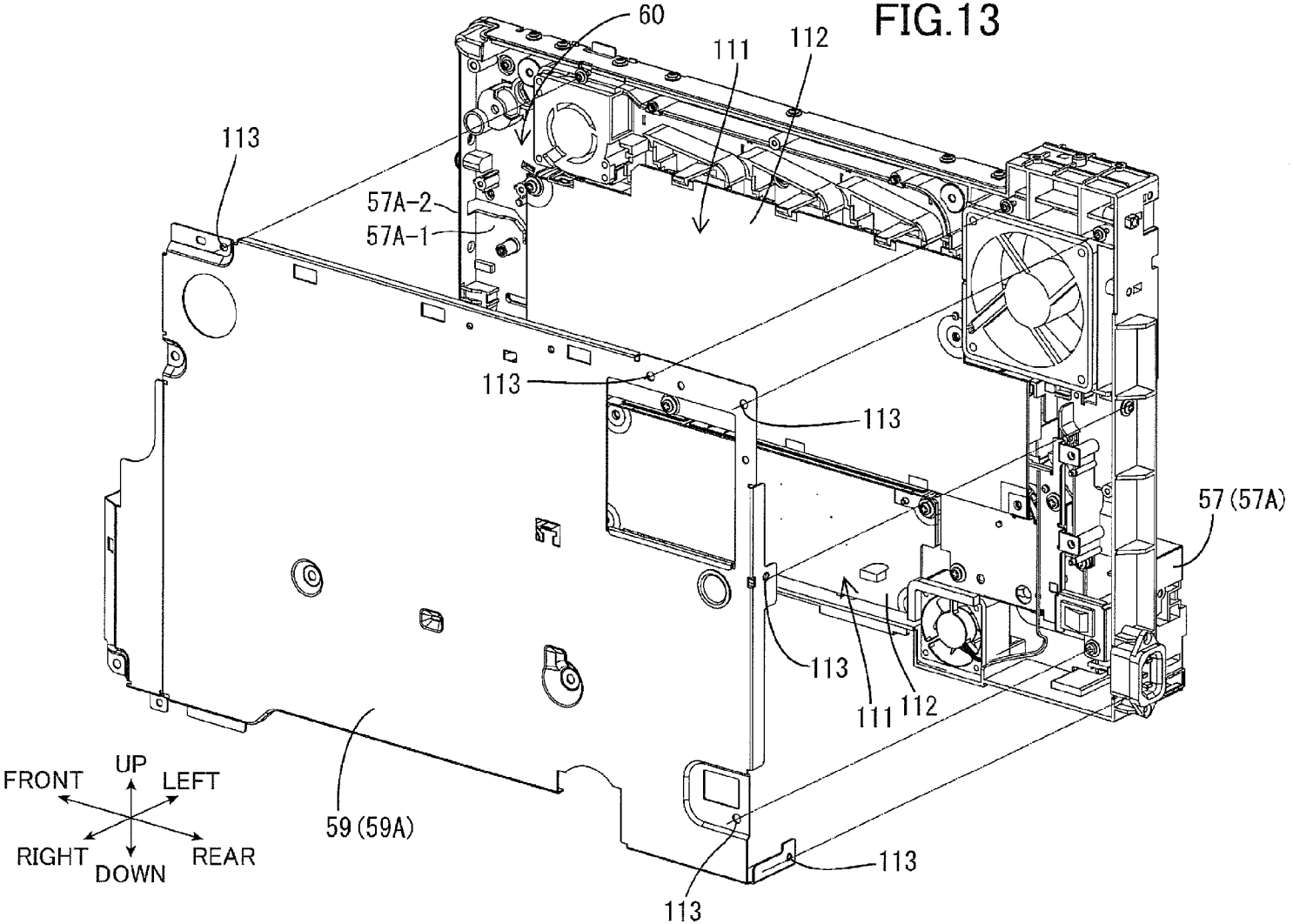
FIG. 13 is a perspective view showing the mounted structure of the resin frame and an outer-side sheet metal frame for the right side wall.

Similarly, as shown in FIGS. 12 and 13, the right resin frame 57A has: a main wall 57A-1 that extends vertically and horizontally; and a peripheral wall 57A-2 that extends from the peripheral edge of the main wall 57A-1 outward in the thickness direction (rightward). The main wall 57A-1 has a pair of opposite surfaces: an outward-facing surface facing outwardly in the thickness direction (rightward); and an inward-facing surface facing inwardly in the thickness direction (leftward). As shown in FIG. 12, the right inner-side sheet metal frame 58A is superimposed over and mounted on the inward-facing surface of the main wall 57A-1. As shown in FIG. 13, the right outer-side sheet metal frame 59A is provided confronting the outward-facing surface of the main wall 57A-1 and is attached to the right resin frame 57A covering the open surface of the accommodating recessed part 60. Thus, the accommodating recessed part 60 is surrounded and enclosed by the main wall 57A-1, the peripheral wall 57A-2, and the right outer-side sheet metal frame 59A.

It is noted that as shown in FIGS. 5 and 10, the left inner-side sheet metal frame 58B is mounted on the left resin frame 57B so as to overlap a region of approximately one-half the top end of the left resin frame 57B. Similarly, as shown in FIGS. 4 and 12, the right inner-side sheet metal frame 58A is mounted on the right resin frame 57A so as to overlap a region of approximately one-half the top end of the right resin frame 57A. Thus, each inner-side sheet metal frame 58 is mounted on the corresponding resin frame 57 so as to overlap a region of approximately one-half the top end thereof. As shown in FIGS. 4 and 5, the inner-side sheet metal frames 58 are fixed to the resin frames 57 by screws 94.

As shown in FIGS. 5 and 13, the right outer-side sheet metal frame 59A is mounted so as to cover substantially the entire surface of the right resin frame 57. As shown in FIGS. 4 and 11, the left outer-side sheet metal frame 59B is mounted so as to cover substantially the entire surface of the left resin frame 57B. Thus, each outer-side sheet metal frame 59 is mounted so as to cover substantially the entire surface of the corresponding resin frame 57. As shown in FIGS. 2 and 3, each outer-side sheet metal frame 59 is fixed to the corresponding resin frame 57 via screws 94B.

As shown in FIGS. 5 and 13, the right outer-side sheet metal frame 59A has a substantially rectangular shape. As shown in FIGS. 4 and 11, the left outer-side sheet metal frame 59B is configured of a combination of the left upper-side outer-side sheet metal frame 59C and the left lower-side outer-side sheet metal frame 59D. The left upper-side outer-side sheet metal frame 59C encloses approximately the top half of the left resin frame 57B, while the left lower-side outer-side sheet metal frame 59D encloses approximately the lower half of the left resin frame 57B as shown in FIG. 11. As shown in FIG. 3, the left lower-side outer-side sheet metal frame 59D is connected to the left upper-side outer-side sheet metal frame 59C with screws 94C.

As shown in FIGS. 3, 4, and 5, the metal reference shaft 90 is mounted so as to bridge the pair of the side walls 56. The reference shaft 90 is formed in a circular rod shape. As will be described later in greater detail, sheet metal-side insertion through-holes 93A are formed in bottom rear corners of the inner-side sheet metal frames 58 as shown in FIGS. 10 and 12. The ends of the reference shaft 90 are inserted into the sheet metal-side insertion through-holes 93A and fixed in position in the inner-side sheet metal frames 58.

With the above-described configuration, the inner-side sheet metal frame 58 mounted on the resin frame 57 reinforces the same. The outer-side sheet metal frame 59 mounted on the resin frame 57 further reinforces the same.

Figure 14:
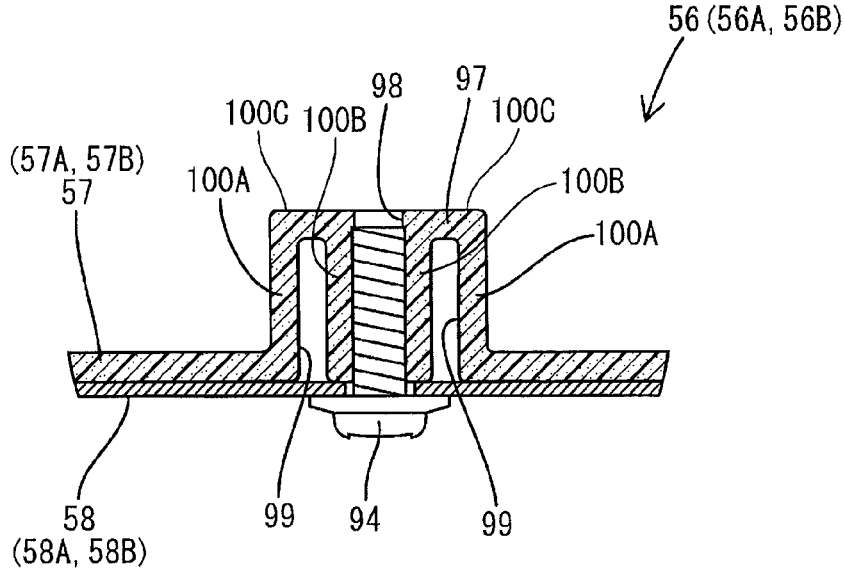
FIG. 14 is an enlarged cross-sectional view illustrating how the resin frame is fixed to the inner-side sheet metal frame via a combination of a screw and a threaded boss.

As shown in FIG. 10, four fixing through-holes 95 and one positioning through-hole 195 are formed through the left inner-side sheet metal frame 58B. Four fixing threaded through-holes 98 are formed through the left resin frame 57B at positions corresponding to the four fixing through-holes 95. Each fixing threaded through-hole 98 is formed in a fixing threaded boss 97. The fixing threaded boss 97 is formed on the outer side of the left resin frame 57B in the thickness direction of the left resin frame 57B and protrudes outwardly in the thickness direction as shown in FIG. 14.

Figure 6:
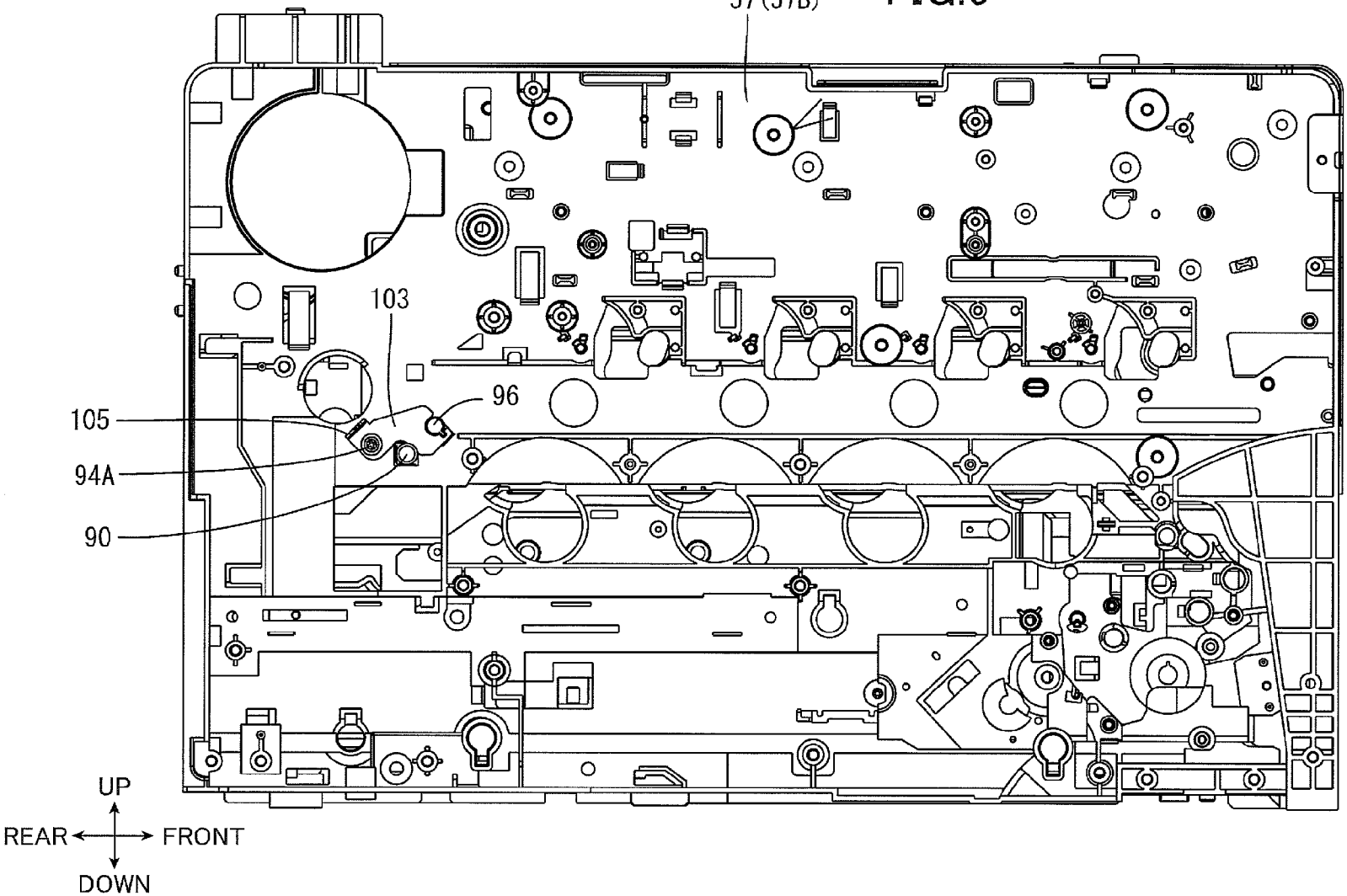
FIG. 6 is a left side view of a left side wall, from which an outer-side sheet metal frame and a drive mechanism have been removed.

As shown in FIG. 10, one positioning threaded hole 198 is formed on the inner side of the left resin frame 57B in the thickness direction thereof at a position corresponding to the positioning through-hole 195. The positioning threaded hole 198 is provided in a positioning threaded boss 96. The positioning threaded boss 96 is formed on the outer side of the left resin frame 57B in the thickness direction of the left resin frame 57B to protrude outwardly in the thickness direction as shown in FIG. 6. Thus, although not shown in the drawings, the fixing threaded bosses 97 and positioning threaded boss 96 protrude in the accommodating recessed part 60 of the left resin frame 57B.

As shown in FIG. 5, a screw 94 is inserted through the positioning through-hole 195 and into the positioning threaded hole 198 to position and fix the left inner-side sheet metal frame 58B relative to the left resin frame 57B. Other screws 94 are inserted through the fixing through-holes 95 and through the fixing threaded through-holes 98 to fix the left inner-side sheet metal frame 58B relative to the left resin frame 57B.

As shown in FIG. 12, three fixing through-holes 95 and one positioning through-hole 195 are formed through the right inner-side sheet metal frame 58A. Three fixing threaded through-holes 98 are formed through the right resin frame 57A at positions corresponding to the three fixing through-holes 95. One positioning threaded hole 198 is formed on the right resin frame 57A at a position corresponding to the positioning through-hole 195. Each fixing threaded through-hole 98 is formed in a fixing threaded boss 97. The fixing threaded boss 97 is formed on the outer side of the right resin frame 57A in the thickness direction of the right resin frame 57A to protrude outwardly in the thickness direction as shown in FIG. 14. The positioning threaded hole 198 is formed in a positioning threaded boss 96. The positioning threaded boss 96 is formed on the outer side of the right resin frame 57A in the thickness direction of the right resin frame 57A to protrude outwardly in the thickness direction similarly to the positioning threaded boss 96 on the left resin frame 57B (FIG. 6). Thus, although not shown in the drawings, the fixing threaded bosses 97 and positioning threaded boss 96 protrude in the accommodating recessed part 60 of the right resin frame 57A.

As shown in FIG. 4, a screw 94 is inserted through the positioning through-hole 195 and into the positioning threaded hole 198 to position and fix the right inner-side sheet metal frame 58A relative to the right resin frame 57A. Other screws 94 are inserted through the fixing through-holes 95 and through the fixing threaded through-holes 98 to fix the right inner-side sheet metal frame 58A relative to the right resin frame 57A.

As shown in FIGS. 10 and 12, the positioning through-hole 195 is located on each inner-side sheet metal frame 58 (58A, 58B) at a position diagonally above and in front of the sheet metal-side insertion through-hole 93A. The positioning through-hole 195 is located in proximity to the sheet metal-side insertion through-hole 93A. On each inner-side sheet metal frame 58 (58A, 58B), the positioning through-hole 195 is located nearer to the sheet metal-side insertion through-hole 93A than the fixing through-holes 95. This configuration ensures that the inner-side sheet metal frame 58 is firmly fixed to the resin frame 57 according to the principle of leverage.

Figure 7:
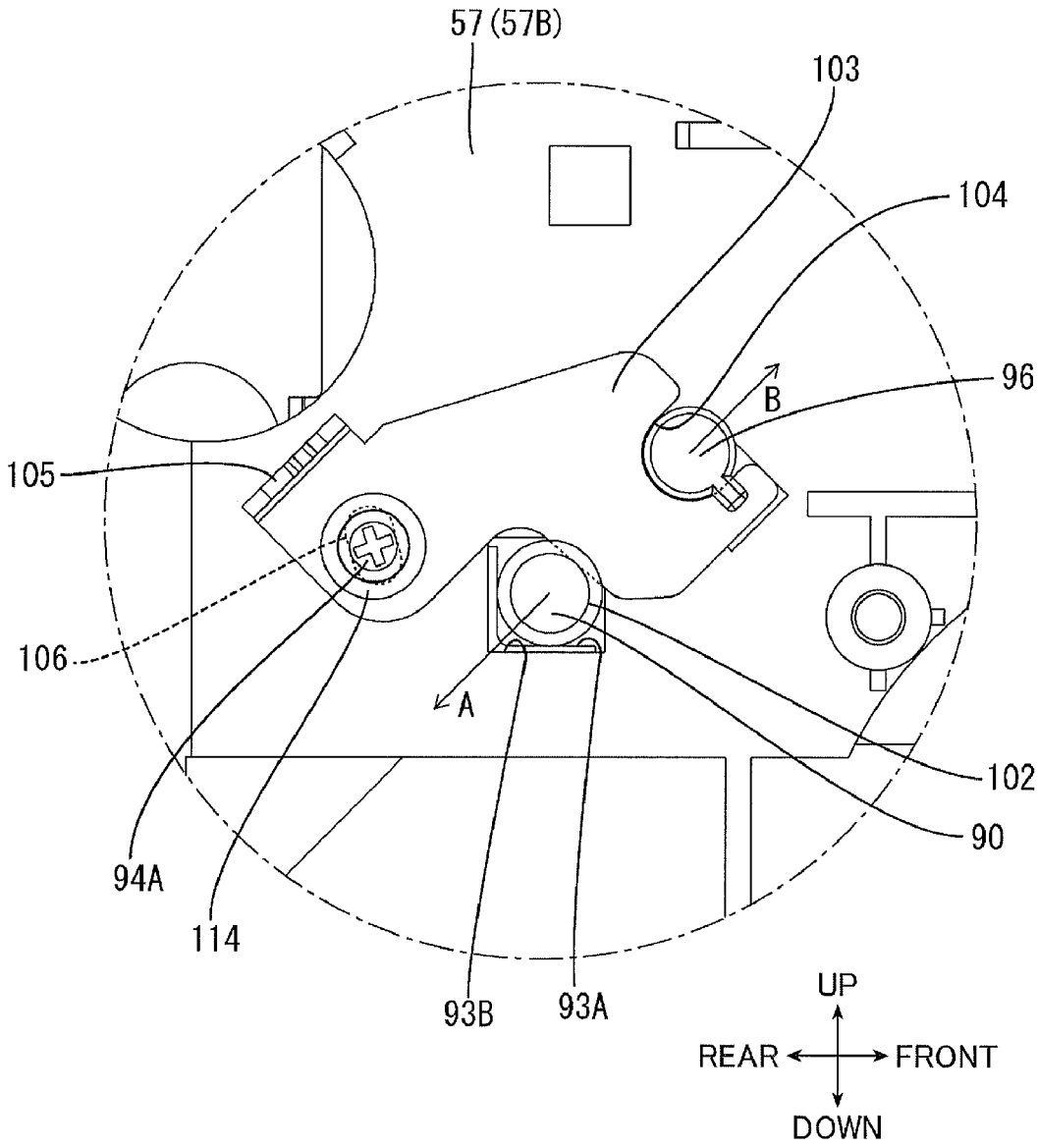
FIG. 7 is an enlarged side view of an essential part in FIG. 6, showing the structure in which the reference shaft is mounted in the left side wall.

As shown in FIGS. 6 and 7, the positioning threaded boss 96 is integrally formed on the left resin frame 57B at a position corresponding to the positioning through-hole 195 formed in the left inner-side sheet metal frame 58B, and protrudes outward in the thickness direction of the left resin frame 57B. Although not shown in the drawings, the positioning threaded boss 96 is integrally formed also on the right resin frame 57A at a position corresponding to the positioning through-hole 195 formed in the right inner-side sheet metal frame 58A, and protrudes outward in the thickness direction of the right resin frame 57A. Each positioning threaded boss 96 has the positioning threaded hole 198 for receiving the screw 94 therein.

The right inner-side sheet metal frame 58A and the right resin frame 57A are positioned relative to each other by placing them superimposed one on the other and screwing the screw 94 into the threaded positioning boss 96 formed near the sheet metal-side insertion through-hole 93A, which then fixes the reference shaft 90 in position relative to the right inner-side sheet metal frame 58A. The left inner-side sheet metal frame 58B and left resin frame 57B are positioned relative to each other by placing them superimposed one on the other and screwing the screw 94 into the threaded positioning boss 96 formed near the sheet metal-side insertion through-hole 93A, which then fixes the reference shaft 90 in position relative to the left inner-side sheet metal frame 58B. As described above, the process unit 25 is positioned relative to the reference shaft 90. So, the process unit 25 is positioned relative to the resin frames 57 via the inner-side sheet metal frames 58.

If the threaded positioning boss 96 were formed at a position farther from the sheet metal-side insertion through-hole 93A, changes in temperature could change the longitudinal dimension along the wall surface of the resin frame 57 and inner-side sheet metal frame 58 between the threaded positioning boss 96 and the sheet metal-side insertion through-hole 93A, resulting in concern that the positioning between the process unit 25 and the resin frame 57 is less precise.

According to the embodiment, the threaded positioning boss 96 for positioning the inner-side sheet metal frame 58 relative to the resin frame 57 is formed near the sheet metal-side insertion through-hole 93A functioning to fix the position of the reference shaft 90, which in turn positions the process unit 25 relative to the inner-side sheet metal frame 58. Since this structure minimizes any change in the longitudinal dimension between the sheet metal-side insertion through-hole 93A and the threaded positioning boss 96 caused by changes in temperature, the process unit 25 can be positioned relative to the resin frame 57 with high precision.

Figure 15:
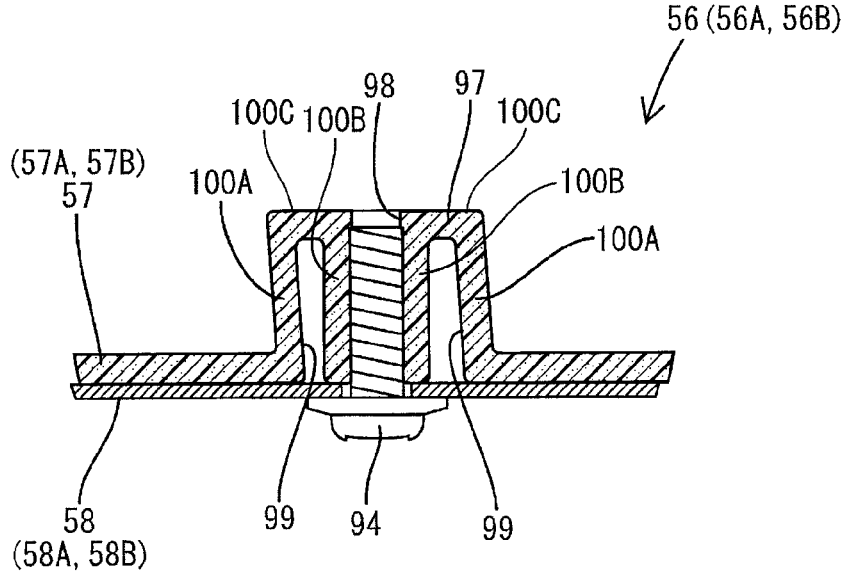
FIG. 15 is an enlarged cross-sectional view showing how the peripheral wall of the threaded boss is deformed by flexing.

As shown in FIG. 12, among the three fixing through-holes 95 on the right inner-side sheet metal frame 58A, two fixing through-holes 95 are formed in positions near both of the front and rear ends along the upper edge of the right inner-side sheet metal frame 58A, and one fixing through-hole 95 is formed in a position near the front and bottom edge of the right inner-side sheet metal frame 58A. Three fixing threaded bosses 97 are provided on the outer side of the right resin frame 57A in the thickness direction thereof at positions corresponding to the fixing through-holes 95, and protrude outward from the right resin frame 57A in the thickness direction thereof. A fixing threaded through-hole 98 for receiving the screw 94 is formed in each fixing threaded boss 97. An annular recessed part 99 is formed in each fixing threaded boss 97 so as to encircle the fixing threaded through-hole 98. The annular recessed part 99 is opened on the inner side of the right resin frame 57A in the thickness direction thereof opposing the right inner-side sheet metal frame 58A, and extends in the fixing threaded boss 97 in the thickness direction of the right resin frame 57A away from the right inner-side sheet metal frame 58A as shown in FIG. 14. With this construction, an outer columnar-shaped peripheral part 100A of the fixing threaded boss 97 can flex and deform in a direction along the plate surface of the right resin frame 57A as shown in FIG. 15.

More specifically, as shown in FIG. 14, each fixing threaded boss 97 includes: the outer columnar-shaped peripheral part 100A that extends from the right resin frame 57A in a direction away from the right inner-side sheet metal frame 58A; an inner columnar-shaped peripheral part 100B that extends from the right resin frame 57A in a direction away from the right inner-side sheet metal frame 58A and that is coaxial with the outer columnar-shaped peripheral part 100A; and a tip end connecting part 100C that extends radially outwardly from a tip end of the inner columnar-shaped peripheral part 100B to a tip end of the outer columnar-shaped peripheral part 100A, thereby connecting the tip end of the inner columnar-shaped peripheral part 100B with the tip end of the outer columnar-shaped peripheral part 100A. The inner columnar-shaped peripheral part 100B is provided around the fixing threaded through-hole 98. The inner columnar-shaped peripheral part 100B is coaxial with the fixing threaded through-hole 98 that is of a cylindrical shape. The annular recessed part 99 is surrounded by the outer columnar-shaped peripheral part 100A, the inner columnar-shaped peripheral part 100B, and the tip end connecting part 100C. This configuration allows the outer columnar-shaped peripheral part 100A to be capable of flexing and deforming.

Similarly, as shown in FIG. 10, among the four fixing through-holes 95 on the left inner-side sheet metal frame 58B, three fixing through-holes 95 are formed in positions near the front and rear ends and the approximate center along the upper edge of the left inner-side sheet metal frame 58B, and one fixing through-hole 95 is formed in a position near the front and bottom edge of the left inner-side sheet metal frame 58B. Four fixing threaded bosses 97 are provided on the outer side of the left resin frame 57B in the thickness direction thereof at positions corresponding to the fixing through-holes 95, and protrude outward from the left resin frame 57B in the thickness direction thereof. A fixing threaded through-hole 98 for receiving the screw 94 is formed in each fixing threaded boss 97. An annular recessed part 99 is formed in each fixing threaded boss 97 so as to encircle the fixing threaded through-hole 98. The annular recessed part 99 is opened on the inner side of the left resin frame 57B in the thickness direction thereof opposing the left inner-side sheet metal frame 58B, and extends in the fixing threaded boss 97 in the thickness direction of the left resin frame 57B away from the left inner-side sheet metal frame 58B as shown in FIG. 14. With this construction, an outer columnar-shaped peripheral part 100A of the fixing threaded boss 97 can flex and deform in a direction along the plate surface of the left resin frame 57B as shown in FIG. 15. It is noted that each fixing threaded boss 97 on the left resin frame 57B has the same configuration with the fixing threaded boss 97 on the right resin frame 57A described above with reference to FIGS. 14 and 15.

With the above-described configuration, the right resin frame 57A and right inner-side sheet metal frame 58A are laminated over each other in the thickness direction of each as shown in FIG. 14, and are positioned relative to each other by inserting a screw 94 through the positioning through-hole 195 formed in the right inner-side sheet metal frame 58A and screwing the screw 94 into the positioning threaded hole 198 formed in the positioning threaded boss 96 of the right resin frame 57A, and are fixed together by inserting the screws 94 through the three fixing through-holes 95 formed in the right inner-side sheet metal frame 58A and screwing the screws 94 into the three fixing threaded through-holes 98 formed in the three fixing threaded bosses 97 of the right resin frame 57A.

Similarly, the left resin frame 57B and left inner-side sheet metal frame 58B are laminated over each other in the thickness direction of each as shown in FIG. 14, and are positioned relative to each other by inserting a screw 94 through the positioning through-hole 195 formed in the left inner-side sheet metal frame 58B and screwing the screw 94 into the positioning threaded hole 198 formed in the positioning threaded boss 96 of the left resin frame 57, and are fixed together by inserting the screws 94 through the four fixing through-holes 95 formed in the left inner-side sheet metal frame 58B and screwing the screws 94 into the four fixing threaded through-holes 98 formed in the four fixing threaded bosses 97 of the left resin frame 57B.

In this way, the mounting structure for the right resin frame 57A and right inner-side sheet metal frame 58A and for the left resin frame 57B and left inner-side sheet metal frame 58B are substantially identical.

By superimposing each inner-side sheet metal frame 58 over the wall surface of the corresponding resin frame 57 and fixing the inner-side sheet metal frame 58 to the resin frame 57 by screws 94, it is possible to improve the stiffness of the resin frame 57, thereby further improving the positioning accuracy for the modules disposed in the resin frame 57. However, since the coefficient of linear expansion for the resin frame 57 differs from that for the inner-side sheet metal frame 58 in this construction, the longitudinal dimensions of the resin frame 57 and inner-side sheet metal frame 58 along the wall surfaces thereof change differently due to changes in temperature, potentially causing warpage in the laminated structure of the resin frame 57 and inner-side sheet metal frame 58. This raises concern for the positioning accuracy of modules supported on the resin frame 57 and inner-side sheet metal frame 58.

In view of this problem, the embodiment has the recessed part 99 formed in the side of the fixing threaded boss 97 opposing the inner-side sheet metal frame 58 and encircling the fixing threaded through-hole 98 so that the outer peripheral part 100A of the fixing threaded boss 97 positioned on the outside of the recessed part 99 can flex and deform as shown in FIG. 15. By flexing and deforming in this way, the outer peripheral part 100A of the fixing threaded boss 97 can absorb differences in changes of the longitudinal dimensions in the resin frame 57 and inner-side sheet metal frame 58 caused by differing coefficients of linear expansion. As a result, this construction can prevent warpage in the resin frame 57 and inner-side sheet metal frame 58 caused by changes in temperature, thereby maintaining positioning precision in the laser printer 1.

Further, since the recessed part 99 is formed around the fixing threaded through-hole 98 in the embodiment, this structure can reliably absorb changes in the longitudinal dimensions along the wall surfaces of the resin frame 57 and inner-side sheet metal frame 58 accompanying changes in temperature.

As shown in FIG. 10, one sheet metal-side insertion through-hole 93A is formed through the left inner-side sheet metal frame 58B as a square through-hole with a diameter sufficient for the reference shaft 90 to be inserted with some play. A resin-side support shaft insertion through-hole 93B is formed as a square-shaped through-hole in the left resin frame 57B at a position corresponding to the sheet metal-side insertion through-hole 93A in the left inner-side sheet metal frame 58B.

Similarly, as shown in FIG. 12, another sheet metal-side insertion through-hole 93A is formed through the right inner-side sheet metal frame 58A as a square through-hole with a diameter sufficient for the reference shaft 90 to be inserted with some play. Another resin-side support shaft insertion through-hole 93B is formed as a square-shaped through-hole in the right resin frame 57A at a position corresponding to the sheet metal-side insertion through-hole 93A in the right inner-side sheet metal frame 58A.

As shown in FIGS. 10 and 12, a substantially L-shaped protrusion 101 is formed along the top and front edges of the resin-side support shaft insertion through-hole 93B protruding inward in the thickness direction of each resin frame 57 (57A, 57B). When the inner-side sheet metal frame 58 (58A, 58B) is fixed to the resin frame 57 (57A, 57B), as shown in FIGS. 4 and 5, the protrusion 101 penetrates the sheet metal-side insertion through-hole 93A from the outer side in the thickness direction of the inner-side sheet metal frame 58 (58A, 58B).

As shown in FIGS. 4 and 5, both ends of the reference shaft 90 are inserted through the sheet metal-side insertion through-holes 93A and resin-side support shaft insertion through-holes 93B with play. It is noted that as shown in FIG. 7, when the left inner-side sheet metal frame 58B is fixed to the left resin frame 57B, the lower edge of the resin-side support shaft insertion through-hole 93B is positioned lower than the lower edge of the sheet metal-side insertion through-hole 93A. Additionally, the rear edge of the resin-side support shaft insertion through-hole 93B is positioned rearward of the rear edge of the sheet metal-side insertion through-hole 93A.

Similarly, although not shown in the drawings, when the right inner-side sheet metal frame 58A is fixed to the right resin frame 57A, the lower edge of the resin-side support shaft insertion through-hole 93B is positioned lower than the lower edge of the sheet metal-side insertion through-hole 93A. The rear edge of the resin-side support shaft insertion through-hole 93B is positioned rearward of the rear edge of the sheet metal-side insertion through-hole 93A. Accordingly, the reference shaft 90 contacts the bottom edges of the sheet metal-side insertion through-holes 93A on both of the right and left inner-side sheet metal frames 58. The reference shaft 90 contacts the rear edges of the sheet metal-side insertion through-holes 93A on both of the right and left inner-side sheet metal frames 58.

As shown in FIG. 7, a groove 102 is formed in the circumferential direction of the reference shaft 90 at a position near one longitudinal end (left end) of the reference shaft 90 in a region that protrudes outward from the left resin frame 57B in the thickness direction thereof when the reference shaft 90 is inserted into the sheet metal-side insertion through-hole 93A in the left inner-side sheet metal frame 58B and the resin-side support shaft insertion through-hole 93B in the left resin frame 57B. Similarly, although not shown in the drawings, another groove 102 is formed in the circumferential direction of the reference shaft 90 at a position near the other longitudinal end (right end) of the reference shaft 90 in a region that protrudes outward from the right resin frame 57A in the thickness direction thereof when the reference shaft 90 is inserted into the sheet metal-side insertion through-hole 93A in the right inner-side sheet metal frame 58A and the resin-side support shaft insertion through-hole 93B in the right resin frame 57A.

Metal fixing cam plates 103 are provided over both of the right and left resin frames 57 on their outside surfaces in their thickness directions. In other words, the metal fixing cam plates 103 are provided in the accommodating recessed parts 60 in both of the right and left resin frames 57. Each metal fixing plate 103 is fitted inside the corresponding groove 102. The fixing cam plate 103 has a general S-shape. A threaded boss fitting part 104 is formed on a front edge of the fixing cam plate 103 for fitting over a base end of the positioning threaded boss 96 that is provided on the outer side of the resin frame 57 in the thickness direction thereof. A pressing part 105 is provided on the rear end of the fixing cam plate 103 and protrudes outward in the thickness direction of the resin frame 57. The pressing part 105 is used for pressing the fixing cam plate 103 downward. A through-hole 106 is formed in the rear part of the fixing cam plate 103 through the thickness of the plate for inserting a screw 94A used to fix the fixing cam plate 103 to the resin frame 57 and the inner-side sheet metal frame 58. In the embodiment, the through-hole 106 is a thin and elongated hole following part of an arc centered on the positioning threaded boss 96. The through-hole 106 may also be a round hole, provided that the screw 94A can be inserted with play. A through-hole (not shown) for inserting the screw 94A is also formed through the resin frame 57 in the thickness direction thereof at a position that corresponds to the through-hole 106 of the fixing cam plate 103 that is located when the pressing part 105 is in a pressed state. A burring part 107 (see FIGS. 10 and 12) in which the screw 94A can be screwed is formed in the inner-side sheet metal frame 58 at a position corresponding to the through-hole formed in the resin frame 57.

The reference shaft 90 and inner-side sheet metal frames 58 are fixed in position with reference to each other as described below.

First, while the reference shaft 90 is inserted through the sheet metal-side insertion through-holes 93A of the inner-side sheet metal frames 58 and the resin-side support shaft insertion through-holes 93B of the resin frames 57, the threaded boss fitting parts 104 of the fixing cam plates 103 are fitted onto the base ends of the threaded positioning bosses 96. By pressing downward on the pressing part 105 of each fixing cam plate 103 in this state, the fixing cam plate 103 rotates about the positioning threaded boss 96 (counterclockwise in FIG. 7). Consequently, the lower edge of each fixing cam plate 103 engages in the top of the groove 102 formed in the reference shaft 90 and contacts the top of the reference shaft 90. As the pressing part 105 is pressed farther downward, the fixing cam plate 103 applies pressure to the reference shaft 90 in the direction of the arrow A, pushing the reference shaft 90 against the bottom and rear edges of the sheet metal-side insertion through-hole 93A. Similarly, pressure is applied to the positioning threaded boss 96 in the direction indicated by the arrow B. While each fixing cam plate 103 is rotated by pressing the pressing part 105, the screw 94A is inserted through a washer 114, the through-hole 106 in the fixing cam plate 103, and the through-hole in the resin frame 57, and is screwed into the burring part 107 in the inner-side sheet metal frame 58. Hence, each fixing cam plate 103 is fixed to the inner-side sheet metal frame 58 while applying pressure in a direction separating the positioning threaded boss 96 and the reference shaft 90. As a result, both ends of the reference shaft 90 are positioned while contacting points on the lower and rear edges of the sheet metal-side insertion through-holes 93A formed in the inner-side sheet metal frames 58.

As shown in FIGS. 11 and 13, the accommodating recessed parts 60 are formed in the resin frames 57 by extending the peripheral edges of the resin frames 57 outward in the thickness direction to form an accommodating space that opens outwardly in the thickness direction. The outer-side sheet metal frame 59 is fixed to each resin frame 57 so as to cover the open surface of the accommodating recessed part 60 and enclose the accommodating recessed part 60. A plurality of through-holes 113 for inserting screws 94B (FIGS. 2 and 3) is formed in each outer-side sheet metal frame 59 penetrating in the thickness direction. Threaded holes (not shown) are formed in each resin frame 57 at positions corresponding to the through-holes 113 for screwing in the screws 94B. The resin frame 57 and outer-side sheet metal frame 59 are fixed together by inserting the screws 94B through the through-holes 113 in the outer-side sheet metal frame 59 and screwing the screws 94B into the threaded holes formed in the resin frame 57.

As shown in FIGS. 3 and 11, a plurality of through-holes 117 is formed in the thickness direction through the left lower-side outer-side sheet metal frame 59D for inserting other screws 94C. Burring parts 107A are formed in the left upper-side outer-side sheet metal frame 59C at positions corresponding to the through-holes 117 for screwing the screws 94C. The left upper-side outer-side sheet metal frame 59C and left lower-side outer-side sheet metal frame 59D are fixed together by inserting the screws 94C in the through-holes 117 and screwing the screws 94C into the burring parts 107A.

Since the outer-side sheet metal frame 59 covers the open surface of the resin frame 57 forming an accommodating space, the cross-sectional area of the side wall 56 is increased by the accommodating recessed part 60 enclosed by the resin frame 57 and outer-side sheet metal frame 59. Since the outer-side sheet metal frames 59 can improve the strength of the side walls 56, the strength of the overall laser printer 1 is improved.

Figure 16:
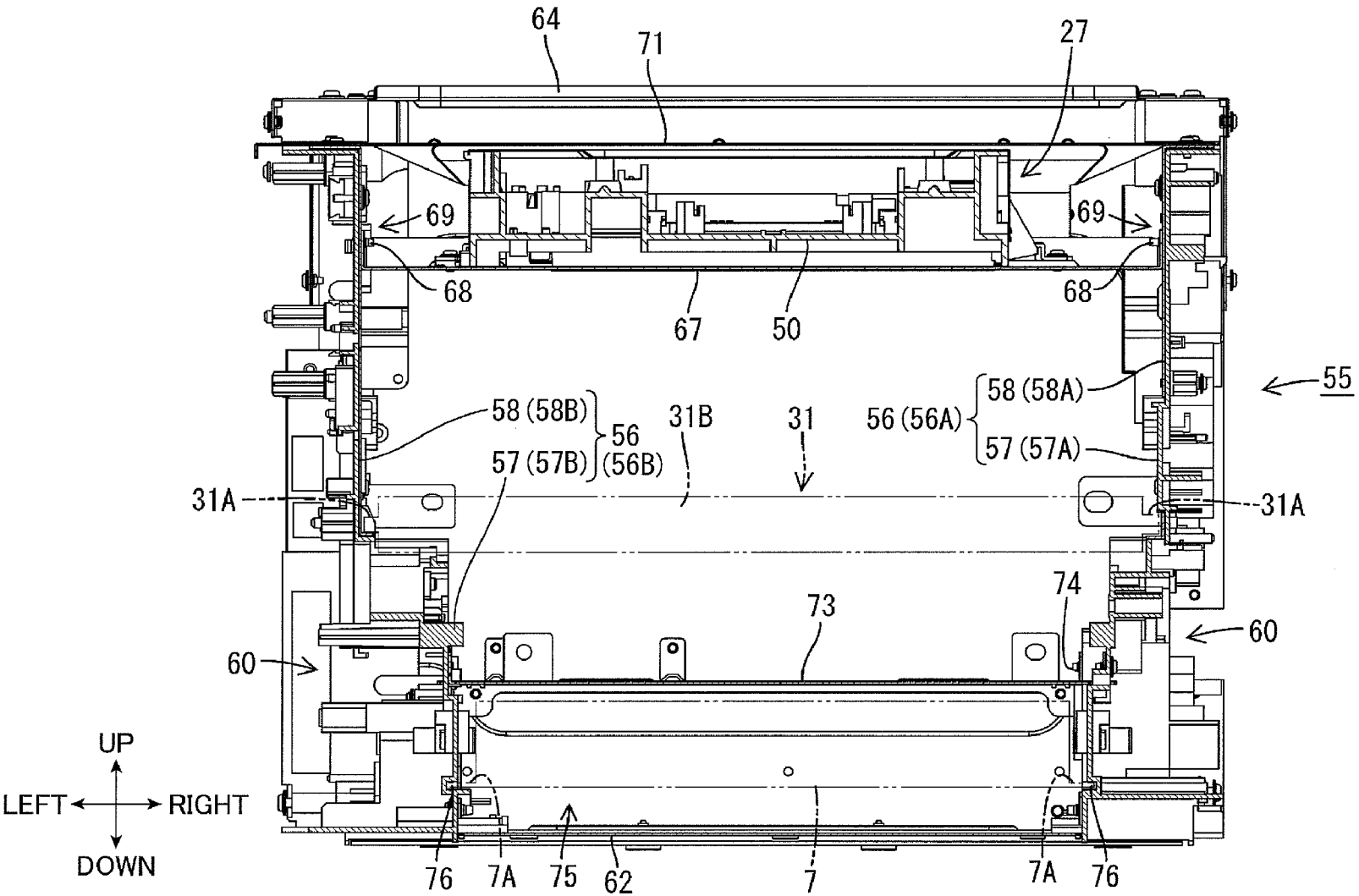
FIG. 16 is a front cross-sectional view of the main frame body.
Figure 17:
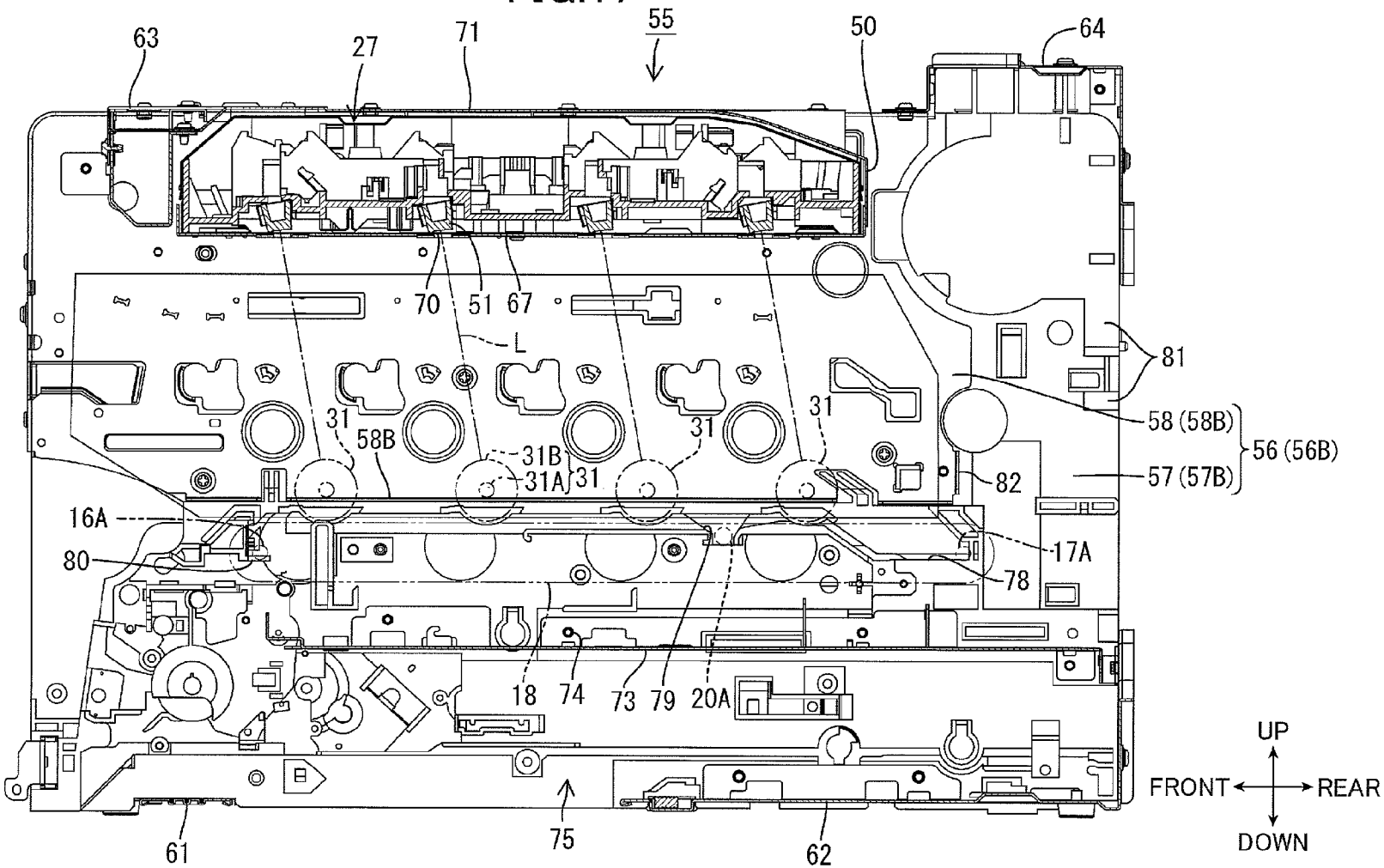
FIG. 17 is a right side cross-sectional view of the main frame body.

As shown in FIG. 16, a metal scanner support plate 67 spans between the side walls 56 in a horizontal orientation at a position between the front beam 63 and rear beam 64 in the top of the side walls 56 (see FIG. 2). The scanner support plate 67 is rectangular in shape, with the four sides bent upward. As shown in FIG. 16, the left and right edges of the scanner support plate 67 are fixed to the inside surfaces of the side walls 56 (inner-side sheet metal frames 58) with fasteners 68. The casing 50 of the scanning unit 27 is placed on the top surface of the scanner support plate 67 and fixed to the scanner support plate 67 with screws. Hence, the scanning unit 27 is supported and positioned by the inner-side sheet metal frames 58 through the scanner support plate 67. Regions of the inner-side sheet metal frames 58 to which the fasteners 68 are attached form scanner positioning parts 69 (see FIGS. 10 and 12). As shown in FIG. 17, slits 70 extending in the left-to-right direction are formed in the scanner support plate 67 at positions corresponding to the irradiating lenses 51 of the scanning unit 27 to allow passage of the laser beams L. A metal top plate 71 (see FIG. 2) spans between the top edges of the side walls 56 for covering the top of the scanning unit 27 at a position between the front beam 63 and rear beam 64.

As shown in FIGS. 2, 16, and 17, a metal base plate 73 is provided in the lower section of the resin frames 57 above the bottom plate 62. The base plate 73 spans horizontally between the resin frames 57, excluding the front regions of the resin frames 57, with the left and right sides of the base plate 73 fixed to the resin frames 57 by fasteners 74. The region surrounded by the base plate 73, bottom plate 62, and left and right resin frames 57 is a cassette accommodating section 75 that accommodates the paper cassette 7, excluding the front portion thereof. Guide grooves 76 are formed in the left and right resin frames 57 along the front-to-rear direction at positions facing the cassette accommodating section 75. Ribs 7A protruding from side surfaces of the paper cassette 7 are inserted into the respective guide grooves 76 to slidingly guide the paper cassette 7 in the front-to-rear direction and to support the paper cassette 7 at a fixed vertical position.

As described above with reference to FIGS. 8 and 9, when the process unit 25 is mounted in the laser printer 1, the cutout parts 91 formed in the rear edges of the frame 29 constituting the process unit 25 grip the reference shaft 90 for positioning the process unit 25 vertically. Consequently, each of the photosensitive drums 31 disposed in the process unit 25 is also positioned vertically. The reference shaft 90 is positioned in the inner-side sheet metal frames 58 using the fixing cam plates 103 to fix the reference shaft 90 in the sheet metal-side insertion through-holes 93A formed in the inner-side sheet metal frames 58. In this way, the photosensitive drums 31 (process unit 25) and the scanning unit 27 are positioned through the reference shaft 90 and the inner-side sheet metal frames 58. Further, as shown in FIGS. 10 and 12, each inner-side sheet metal frame 58 is substantially flat except for its peripheral edge that is bent toward the corresponding resin frame 57. So, the sheet metal-side insertion through-holes 93A and the scanner positioning parts 69 are formed within the same plane. Hence, unlike a conceivable structure in which each inner-side sheet metal frame 58 is bent in steps between the sheet metal-side insertion through-hole 93A and the scanner positioning part 69, for example, the construction of the present embodiment absorbs the effects of molding error produced when bending the sheet metal or the like. Accordingly, this construction improves the precision for positioning the photosensitive drums 31 (process unit 25) relative to the scanning unit 27.

As shown in FIGS. 10, 12, and 17, three belt unit support parts 78, 79, and 80 are formed at positions along the front-to-rear direction on each resin frame 57 (57A, 57B) below the lower edge of the inner-side sheet metal frame 58 (58A, 58B), although the belt support part 80 on the right resin frame 57A is not shown in the drawings. The belt unit support parts 78 of the resin frames 57 on their rear sides are groove shapes that open upward. Especially, as shown in FIG. 10, the belt unit support part 78 on the left resin frame 57B opens in a direction diagonally upward and forward. Bearing members 17A mounted on both ends of a rotational shaft in the belt support roller 17 provided on the rear side are inserted into the belt unit support parts 78. The center belt unit support parts 79 on the resin frames 57 are grooves that also open upward. Positioning protrusions 20A protruding from both side surfaces of the belt frame 20 are fitted into the belt unit support parts 79. The belt unit support parts 80 on the front side are formed in a horizontal plate shape for supporting bearing members 16A mounted on both ends of a rotational shaft in the front belt support roller 16. With this configuration, the belt unit support parts 78, 79, and 80 support the belt unit 15 (including the transfer rollers 19) at a position fixed vertically and in the front-to-rear direction.

Figure 18:
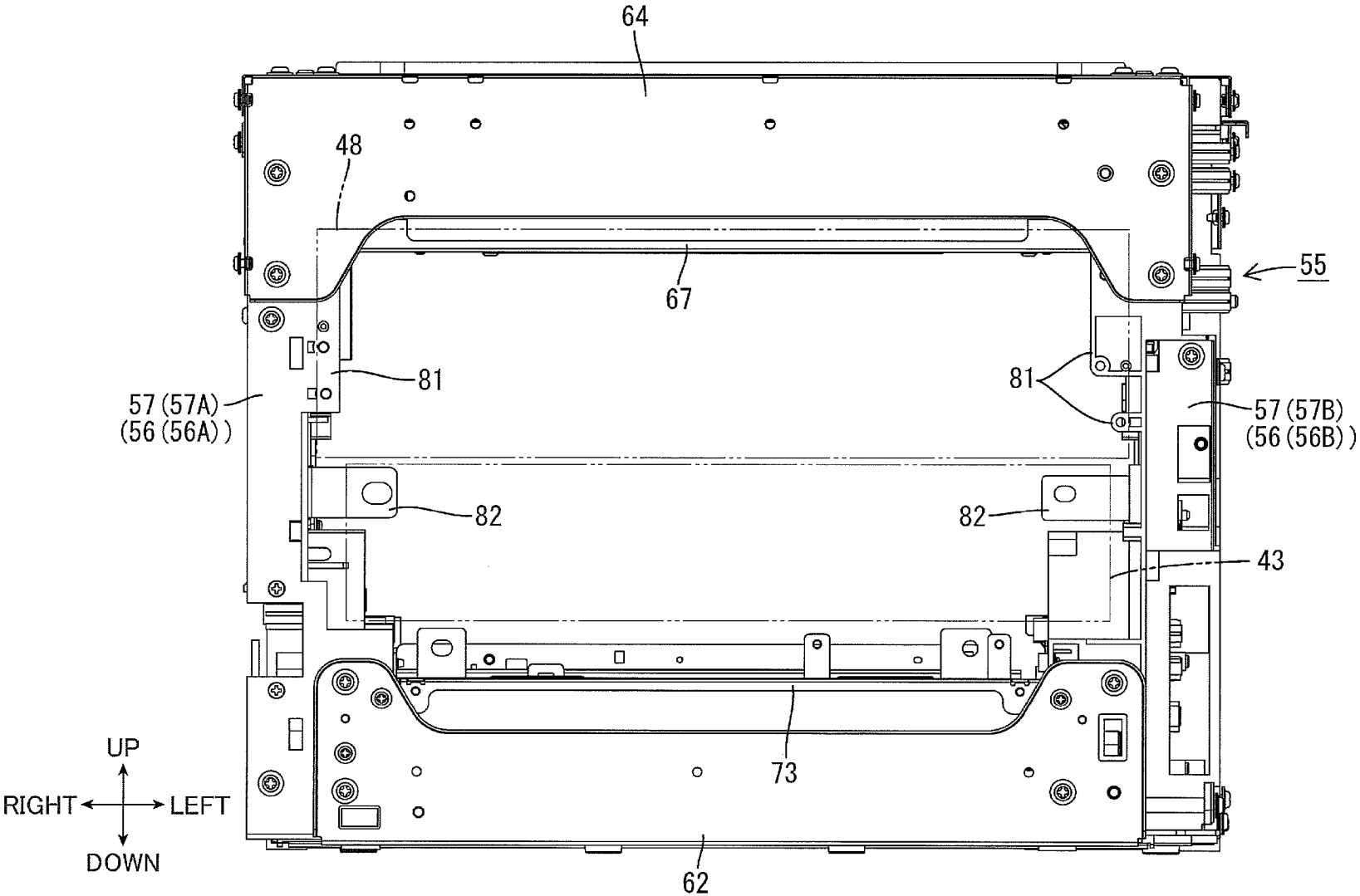
FIG. 18 is a rear view of the main frame body.

As shown in FIG. 18, discharge device mounting units 81 are integrally formed on rear edges of the resin frames 57 and protrude inward. The discharge device 48 is fixed to the discharge device mounting units 81 by screws. Hence, the discharge device mounting units 81 support and position the discharge device 48.

Further, fixing unit mounting units 82 are formed on the rear edges of the inner-side sheet metal frames 58 and protrude inward. The fixing unit 43 is fixed to the fixing unit mounting units 82 by screws. Hence, the fixing unit mounting units 82 support and position the fixing unit 43.

Since the resin frames 57 are easy to mold into complex shapes, the components of the laser printer 1 can be efficiently arranged to achieve a more compact laser printer 1. However, since the resin frames 57 have low stiffness, the inner-side sheet metal frames 58 and the outer-side sheet metal frames 59 are mounted on the resin frames 57 as described above to reinforce the resin frames 57, thereby improving the positioning accuracy of the components.

It is conceivable to form thicker walls on the resin frames 57, for example, in order to further enhance the stiffness of the resin frames 57. However, this conceivable method would increase the weight and size of the laser printer 1 by an amount in which the thickness of the walls is increased. Another possible method for enhancing the stiffness of the resin frames 57 while avoiding an increase in the weight of the laser printer 1 is to provide reinforcing ribs on the walls of the resin frames 57 to increase the cross-sectional surface area of the resin frames 57. However, with this technique, components of the laser printer 1 cannot be disposed in regions occupied by the ribs. Accordingly, since the space in the main casing 2 cannot be used effectively, this method invites an increase in the size of the laser printer 1.

In view of the foregoing, the accommodating recessed part 60 formed in the left resin frame 57B functions to accommodate a drive mechanism 108 used to drive the process unit 25, as shown in FIG. 11. That is, the drive mechanism 108 is for rotating the photosensitive drums 31, the developing rollers 40, the supply rollers 39, and the agitators 42. Further, a circuit board 111 is accommodated in the accommodating recessed part 60 formed in the right resin frame 57A, as shown in FIG. 13. This construction improves the efficiency of using space in the laser printer 1, enabling the laser printer 1 to be made more compact than the conceivable one whose side walls 56 are enlarged with ribs to have the same cross-sectional areas.

As shown in FIG. 11, the drive mechanism 108 includes a motor 109, and a plurality of gears 110. The motor 109 generates a drive force that is transmitted by the gears 110 for driving the process unit 25. When the drive mechanism 108 is operated, noise may be generated by the rotation of the motor 109 and the gears 110 and by vibrations in the gears 110. In the embodiment, the accommodating recessed part 60 is enclosed by the left outer-side sheet metal frame 59B. Hence, the left outer-side sheet metal frame 59B blocks noise generated when operating the drive mechanism 108, reducing the amount of noise that escapes from the laser printer 1. Further, while the drive mechanism 108 tends to be heavy due to the numerous components therein, the drive mechanism 108 can be reliably supported on the left outer-side sheet metal frame 59B, which has a high stiffness.

The circuit board 111 (see FIG. 13) includes an insulating circuit board 112, on which conductive paths (not shown) are formed and electronic parts (not shown) are connected to the conductive paths. The circuit board 111 is provided with electrodes for electrically connecting the developing rollers 40 and the chargers 32 (charging wires and grids) to a bias applying circuit (not shown). The circuit board 111 can overheat if an excess current flows in the circuit board 111 due to a short-circuit, for example. However, since the accommodating recessed part 60 in the embodiment is enclosed by the right outer-side sheet metal frame 59A, which is nonflammable, the structure of the embodiment ensures the safety of the laser printer 1 should the circuit board 111 overheat.

Further, since the open surface of the accommodating recessed part 60 accommodating the circuit board 111 is enclosed by the right outer-side sheet metal frame 59A, the circuit board 111 is shielded by the right outer-side sheet metal frame 59A. Further, since the right inner-side sheet metal frame 58A is laminated over the surface of the right resin frame 57A, the shielding effect for the circuit board 111 is further enhanced.

In the embodiment described above, the open surface in the resin frame 57 forming the accommodating space is covered by the outer-side sheet metal frame 59. This has the effect of increasing the cross-sectional area of the side wall 56 by the depth of the accommodating recessed part 60 enclosed by the resin frame 57 and the outer-side sheet metal frame 59, thereby improving the strength of the side wall 56.

Further, the accommodating recessed parts 60 accommodate the drive mechanism 108 and the circuit board 111, thereby more efficiently using the space in the laser printer 1. Since this construction effectively uses the space in the main casing 2, the laser printer 1 can be made more compact than the conceivable construction that increases the cross-sectional area of the side walls 56 with ribs, for example.

In addition to the outer-side sheet metal frames 59, laminating or superimposing the inner-side sheet metal frames 58 on the resin frames 57 further enhances the strength of the resin frames 57.

Further, a pair of the side walls 56 are provided and arranged in opposition to each other, and lower edges of the side walls 56 are connected with the bottom beam 61 and bottom plate 62, while upper edges of the side walls 56 are connected by the front beam 63 and rear beam 64. Hence, this construction improves the overall strength of the laser printer 1.

In the embodiment, the process unit 25 is positioned by the reference shaft 90, while the reference shaft 90 is fixed in position relative to the inner-side sheet metal frames 58. The inner-side sheet metal frames 58 and the resin frames 57 are positioned relative to each other by placing the resin frames 57 over the inner-side sheet metal frames 58 and screwing screws 94 into the positioning threaded bosses 96 formed near the sheet metal-side insertion through-holes 93A, in which the reference shaft 90 is fixed. The process unit 25 and the resin frames 57 are thus positioned through the inner-side sheet metal frames 58.

In the embodiment, the threaded positioning bosses 96 functioning to position the inner-side sheet metal frames 58 relative to the resin frames 57 are formed near the sheet metal-side insertion through-holes 93A serving to fix the position of the reference shaft 90, which in turn sets the position between the process unit 25 and the inner-side sheet metal frames 58. This construction can minimize the amount of change in the longitudinal dimension between the sheet metal-side insertion through-holes 93A and the threaded positioning bosses 96 occurring due to changes in temperature, thereby positioning the process unit 25 and the resin frames 57 with high accuracy.

Among the plurality of modules, the process unit 25 and scanning unit 27 are supported and positioned by the inner-side sheet metal frames 58 capable of achieving a high positional accuracy. Accordingly, the laser printer 1 can achieve good image quality. Modules that require less rigid precision, such as the belt unit 15, paper cassette 7, discharge device 48, and transfer rollers 19, can be supported and positioned by the resin frames 57. Since the resin frames 57 can be designed with a high degree of freedom, the modules can be efficiently arranged to achieve a compact device.

In the embodiment, the reference shaft 90 mounted in the sheet metal-side insertion through-hole 93A of the inner-side sheet metal frame 58 functions to position the process unit 25. On the other hand, the scanner positioning part 69 formed in the inner-side sheet metal frame 58 along the same plane as the sheet metal-side insertion through-hole 93A functions to position the scanning unit 27. Since the process unit 25 and the scanning unit 27 are positioned along the same plane of the inner-side sheet metal frame 58, these components are not affected by molding error or the like occurring when bending the sheet metal, for example. Hence, this construction improves the positional accuracy of the scanning unit 27 and process unit 25, ensuring high-quality image formation.

Further, the drive mechanism 108 provided for driving the process unit 25 includes the plurality of gears 110 for transmitting the drive force to the process unit 25. Hence, there is some concern that noise may be produced by the vibrations or rattling of the gears 110. The drive mechanism 108 also includes the motor 109 that, when operated, can also generate noise. In view of these problems, the outer-side sheet metal frame 59 is configured to cover the open surface of the accommodating recessed part 60 that accommodates the drive mechanism 108, thereby reducing the amount of noise produced in the drive mechanism 108 that escapes from the accommodating recessed part 60.

There is also some concern that the circuit board 111 might overheat should a short circuit cause excess current to flow therein. However, since the accommodating recessed part 60 accommodating the circuit board 111 is enclosed by the non-flammable outer-side sheet metal frame 59, the safety of the laser printer 1 can be improved even if the circuit board 111 overheats.

Further, the outer-side sheet metal frame 59 covering the open surface of the accommodating recessed part 60, which accommodates the circuit board 111, can shield the circuit board 111. Since the inner-side sheet metal frame 58 is mounted on the resin frame 57, this construction can more reliably shield the circuit board 111.

The recessed part 99 is formed in the fixing threaded boss 97 around the fixing threaded through-hole 98 on the side opposing the inner-side sheet metal frame 58 so that the outer peripheral part 100A of the fixing threaded boss 97 positioned on the outside of the recessed part 99 can flex and deform. Accordingly, the outer peripheral part 100A of the fixing threaded boss 97 can flex and deform to absorb differences in changes in the longitudinal dimensions of the resin frame 57 and inner-side sheet metal frame 58 that occur when the coefficient of linear expansion is different for the resin frame 57 and inner-side sheet metal frame 58. Accordingly, this construction prevents warpage in the resin frame 57 and inner-side sheet metal frame 58 caused by changes in temperature, thereby preserving the positional accuracy of the laser printer 1.

While the invention has been described in detail with reference to the specific embodiment thereof, it would be apparent to those skilled in the art that many modifications and variations may be made therein without departing from the spirit of the invention, the scope of which is defined by the attached claims.

For example, while the drive mechanism 108 and the circuit board 111 are accommodated in the accommodating recessed parts 60 in the embodiment described above, other components may be accommodated in the accommodating recessed parts 60.

While the inner-side sheet metal frames 58 are mounted on the resin frames 57 in the embodiment described above, the inner-side sheet metal frames 58 may be omitted if sufficient strength can be obtained by the resin frames 57 and the outer-side sheet metal frames 59.

Further, in the embodiment described above, the bottom beam 61 and bottom plate 62 connect the bottom edges of the side walls 56 and the front beam 63 and rear beam 64 connect the top edges of the side walls 56. However, at least one of the bottom beam 61, bottom plate 62, front beam 63, and rear beam 64 may be omitted if the main frame body 55 has sufficient strength.

While the reference shaft 90 functions as the positioning part for positioning the process unit 25 in the embodiment, a portion of the inner-side sheet metal frame 58 may be bent, for example, to form positioning parts for positioning the process unit 25.

While the inner-side sheet metal frames 58 support the fixing unit 43 in the embodiment described above, the resin frames 57 may be configured to support the fixing unit 43. That is, the fixing unit mounting units 82 may be formed on the rear edges of the resin frames 57 and protrude inward.

Further, the inner-side sheet metal frames 58 may be configured to support some of the other modules, such as the paper cassette 7, the belt unit 15, and the discharge device 48.

The inner-side sheet metal frames 58 may also be configured to support the transfer rollers 19, thereby improving the positional accuracy of the transfer rollers 19 to prevent problems in color registration caused by deviations in transfer positions.

In the embodiment described above, the color laser printer 1 employs the direct transfer tandem system. However, the color laser printer 1 may be modified to an image-forming device employing an intermediate transfer tandem system or a four-cycle system (single-drum system). The color laser printer 1 may be modified to a single-color image-forming device.

Further, while the laser printer 1 in the embodiment is provided with a plurality of the photosensitive drums 31 as image-carrying members, the laser printer 1 may be modified to an image-forming device provided with a photosensitive belt as the image-carrying member, wherein the photosensitive belt is stretched around a plurality of rollers, for example.

Figure 19:
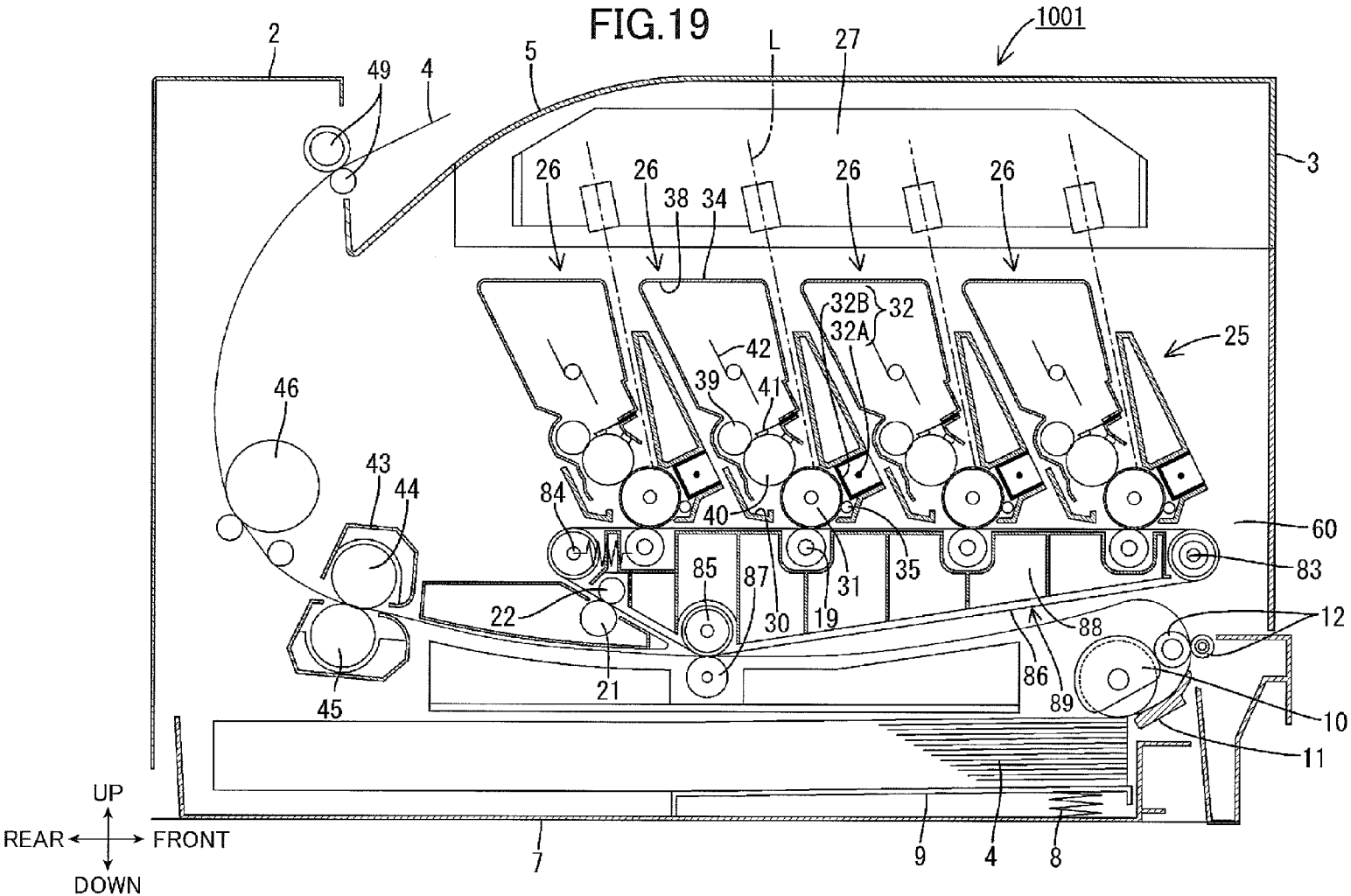
FIG. 19 is a side cross-sectional view showing the general structure of a laser printer according to a modification.

While the image-forming device 1 of the embodiment is provided with the conveying belt 18 for conveying a recording medium, the image-forming device 1 may be modified to an image-forming device 1001 provided with an intermediate transfer belt 86, as shown in FIG. 19.

In this variation, a belt unit 89 is provided in place of the belt unit 15. The belt unit 89 can also be detachably mounted in the main casing 2. The belt unit 89 is the same as the belt unit 15 of the embodiment except for the points described below.

The belt unit 89 includes a belt frame 88 formed of a synthetic resin and having a triangular side cross section. The belt frame 88 is disposed horizontally in the main casing 2 and supports thereon rotatable belt support rollers 83 and 84 disposed on the front and rear ends thereof. A separate belt support roller 85 is rotatably supported on the belt frame 88 at a location between the belt support rollers 83 and 84 and at a position below the same. The intermediate transfer belt 86 formed of a synthetic resin, such as polycarbonate, is stretched around the belt support rollers 83, 84, and 85. By driving the belt support roller 83 disposed on the front side to rotate, the intermediate transfer belt 86 moves circularly in the clockwise direction of FIG. 19 to convey an image formed on the top surface thereof in the forward direction. The belt support roller 84 disposed on the rear side is a tension roller that can be displaced in the front-to-rear direction. Tension is applied to the intermediate transfer belt 86 by urging the belt support roller 84 rearward. As in the embodiment described above, four of the transfer rollers 19 are rotatably disposed in the belt frame 88 at positions opposing each of the photosensitive drums 31 so that the intermediate transfer belt 86 is pinched between the transfer rollers 19 and the corresponding photosensitive drums 31. During a transfer operation for transferring images from the photosensitive drums 31 to the intermediate transfer belt 86, a transfer bias is generated between the transfer rollers 19 and the photosensitive drums 31. A separate transfer roller 87 is disposed in opposition to the belt support roller 85 so that the intermediate transfer belt 86 is pinched between the belt support roller 85 and transfer roller 87. During a transfer operation for transferring an image from the intermediate transfer belt 86 to the paper 4, a transfer bias is generated between the belt support roller 85 and the transfer roller 87.

Toner images carried on the surfaces of the photosensitive drums 31 are sequentially transferred onto the intermediate transfer belt 86 and superimposed over the same region, resulting in a four-color toner image being carried on the intermediate transfer belt 86. When a sheet of the paper 4 fed by the feeding rollers 12 passes through the transfer position between the belt support roller 85 and transfer roller 87, the four-color toner image carried on the intermediate transfer belt 86 is transferred onto the paper 4.

In the embodiment described above, the sheet metal-side insertion through-hole 93A and the scanner positioning part 69 are formed in the inner-side sheet metal frame 58 along the same plane. However, the sheet metal-side insertion through-hole 93A and the scanner positioning part 69 may be formed along different planes if the inner-side sheet metal frame 58 can be bent and shaped with precision.

In the embodiment described above, the fixing threaded through-hole 98 is formed in the fixing threaded boss 97 to penetrate the resin frame 57 in the thickness direction thereof. However, the fixing threaded through-hole 98 may be modified to a threaded hole that does not penetrate the resin frame 57 in the thickness direction thereof.

While the positioning threaded boss 96 is disposed near the reference shaft 90 in the embodiment, the positioning threaded boss 96 may be positioned farther away from the reference shaft 90 or omitted if the dimensional changes of the inner-side sheet metal frame 58 and resin frame 57 are not that different.

While the recessed part 99 is configured of an annular groove formed around the fixing threaded through-hole 98 in the embodiment described above, if changes in the longitudinal dimension along the wall surfaces of the resin frame 57 and inner-side sheet metal frame 58 occur only in a specific direction, the recessed part 99 may be formed in regions around the fixing threaded through-hole 98 intersecting this specific direction.

In the above-described embodiment, the process unit 25 and the scanning unit 27 are supported and positioned by the inner-side sheet metal frames 58. However, the process unit 25 and the scanning unit 27 may be supported and positioned by the outer-side sheet metal frames 59.

In the above-described embodiment, each inner-side sheet metal frame 58 includes: the reference shaft mounting part 93A for mounting the reference shaft 90 thereon; and the scanner positioning part 69 for positioning the scanning unit 27 relative to the inner-side sheet metal frame 58. Instead, each outer-side sheet metal frame 59 may be provided with the reference shaft mounting part 93A for mounting the reference shaft 90 thereon and the scanner positioning part 69 for positioning the scanning unit 27 relative to the outer-side sheet metal frame 59. The reference shaft mounting part 93A and the scanner positioning part 69 are preferably formed along the same plane of the outer-side sheet metal frame 59.

Figure 20:
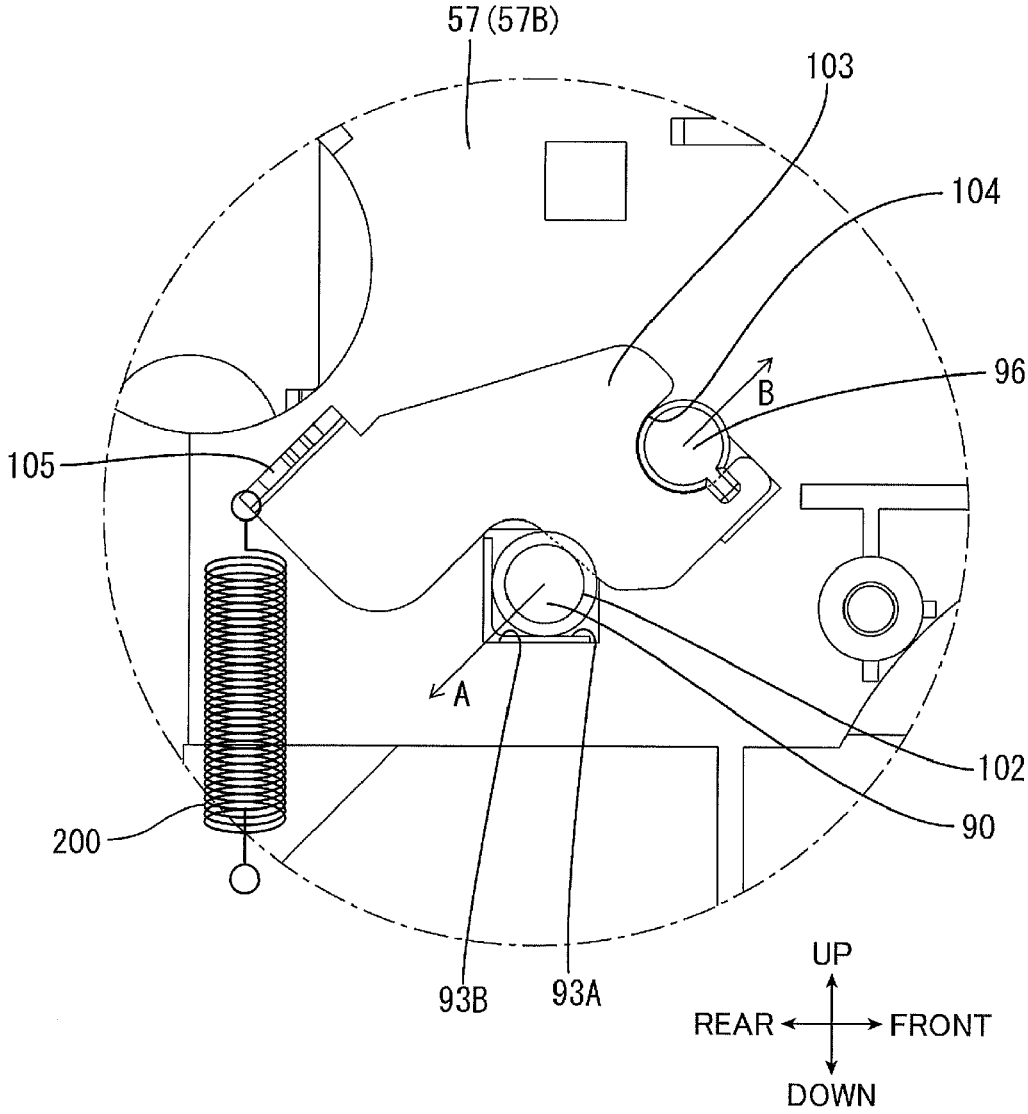
FIG. 20 is an enlarged side view of the essential part in FIG. 6, showing a modification of the structure in which the reference shaft is mounted in the left side wall.

In the embodiment, as described with reference to FIG. 7, the through-hole 106 is formed through the fixing cam plate 103, and the screw 94A is inserted through the through-hole 107 to fix the fixing cam plate 103 to the resin frame 57 and the inner-side sheet metal frame 58. However, the fixing cam plate 103 may not be formed with the through-hole 106. The screw 94A may not be used to fix the fixing cam plate 103 to the resin frame 57 and the inner-side sheet metal frame 58. Instead, as shown in FIG. 20, an urging member such as a coil spring 200 may be provided on the resin frame 57. An upper end of the coil spring 200 is connected to the pressing part 105, while a lower end of the coil spring 200 is connected to the resin frame 57 at a position lower than and rear to the resin-side support shaft insertion through-hole 93B. The coil spring 200 serves to press the fixing cam plate 103 downward. The coil spring 200 operates in the same manner as the screw 94A in the embodiment.

In the embodiment, the fixing cam plate 103 is mounted on each of the right and left resin frames 57 to fix the reference shaft 90 to both of the right and left inner-side sheet metal frames 58. However, the fixing cam plate 103 may be mounted only on either one of the right and left resin frames 57 to fix the reference shaft 90 to only one of the right and left inner-side sheet metal frames 58.

What is claimed is:

1. An image-forming device, comprising:

a side wall unit including:

a resin frame having a first surface and a second surface opposing the first surface; and a sheet metal frame that is mounted over at least a part of the first surface of the resin frame and is fixed to the resin frame by at least one screw;

the resin frame having at least one fixing threaded boss on the second surface, each fixing threaded boss being located at a position corresponding to one of the at least one screw and having a threaded hole opened on the first surface to receive the screw, each fixing threaded boss including an outer peripheral wall and an inner peripheral wall, both of which extend from the second surface in a direction away from the sheet metal frame, tip ends of the outer peripheral wall and the inner peripheral walls being connected, the inner peripheral wall being located around the threaded hole, a recessed part being formed in each fixing threaded boss in at least a part of a portion defined between the outer peripheral wall and the inner peripheral wall, thereby allowing the outer peripheral wall to become capable of flexing and deforming.

2. An image-forming device according to claim 1, further comprising a process unit that is configured to form an image and that is detachably mounted on the side wall unit, wherein the sheet metal frame has a positioning part that positions the process unit relative to the sheet metal frame, and wherein the resin frame has a positioning threaded boss on the second surface, the positioning threaded boss being located at a position nearer to the positioning part than the at least one fixing threaded boss, the positioning threaded boss having a hole that is opened on the first surface to receive another screw that fixes the sheet metal frame relative to the resin frame.

3. An image-forming device according to claim 1, wherein the outer peripheral wall and the inner peripheral wall extend coaxially around the threaded hole, the recessed part being in an annular groove shape that is formed around the inner peripheral wall.

4. An image-forming device according to claim 1, further comprising a plurality of components that cooperate to form an image on a recording medium and that are mounted on the side wall unit.

5. An image-forming device according to claim 4, wherein the plurality of components comprise:

a process unit that includes an image-carrying member; and a scanning unit that exposes the image-carrying member to light, wherein at least the process unit and the scanning unit are supported on and positioned by the sheet metal frame, and other remaining components are supported on and positioned by the resin frame.

6. An image-forming device according to claim 4, wherein the plurality of components include an image-carrying member and a belt that carries thereon either one of a recording medium and a visible image formed on the image-carrying member, the belt being supported on the resin frame.

7. An image-forming device according to claim 4, wherein the plurality of components include a cassette that is capable of accommodating the recording medium and that can be detached from the side wall unit, the cassette being supported on the resin frame.

8. An image-forming device according to claim 4, wherein the plurality of components include a discharge device that discharges the recording medium after an image has been formed thereon, the discharge device being supported on the resin frame.

9. An image-forming device according to claim 4, wherein the plurality of components include a transferring member that transfers a visible image onto the recording medium, the transferring member being supported on the resin frame.

10. An image-forming device according to claim 4, wherein the plurality of components include a fixing unit that fixes a visible image transferred onto the recording medium, the fixing unit being supported on the resin frame.

11. An image-forming device according to claim 1, wherein the side wall unit includes a pair of side walls that are disposed in confrontation with each other and each of which includes the resin frame and the sheet metal frame, further comprising a plurality of components that cooperate to form an image on a recording medium and that are mounted on the side wall unit, wherein the plurality of components comprise:

a process unit that includes an image-carrying member; and a scanning unit that exposes the image-carrying member to light, wherein at least the process unit and the scanning unit are supported on and positioned by the sheet metal frame, the process unit being detachably mounted on the side wall unit, further comprising a positioning unit that positions the process unit relative to the sheet metal frames provided in the pair of side walls, the positioning unit including a reference shaft that is mounted on and spanning between the sheet metal frames provided in the pair of side walls, wherein the sheet metal frame in each side wall includes:

a reference shaft mounting part that mounts the reference shaft thereon; and a scanner positioning part that positions the scanning unit relative to the sheet metal frame, the reference shaft mounting part and the scanner positioning part being formed within the same plane on the sheet metal frame.

* * * * *